US007207641B2

(12) United States Patent
Komatsu et al.

(10) Patent No.: US 7,207,641 B2
(45) Date of Patent: Apr. 24, 2007

(54) INKJET HEAD

(75) Inventors: Katsuaki Komatsu, Hino (JP); Masahiro Makita, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 255 days.

(21) Appl. No.: 10/930,217

(22) Filed: Aug. 31, 2004

(65) Prior Publication Data

US 2005/0052485 A1 Mar. 10, 2005

(30) Foreign Application Priority Data

Sep. 5, 2003 (JP) ..... 2003-314003
Sep. 22, 2003 (JP) ..... 2003-330786

(51) Int. Cl.
*B41J 29/38* (2006.01)
*B41J 2/04* (2006.01)
*B41J 2/05* (2006.01)

(52) U.S. Cl. ..... 347/17; 347/54; 347/62

(58) Field of Classification Search ..... 347/17, 347/60, 62, 54, 56; 219/636
See application file for complete search history.

(56) References Cited

U.S. PATENT DOCUMENTS

| | | | | |
|---|---|---|---|---|
| 4,661,690 | A * | 4/1987 | Yamamoto et al. | 219/549 |
| 5,389,962 | A * | 2/1995 | Sekiya et al. | 347/65 |
| 5,659,346 | A * | 8/1997 | Moynihan et al. | 347/68 |
| 6,575,547 | B2 * | 6/2003 | Sakuma | 347/18 |
| 6,789,880 | B2 * | 9/2004 | Chou et al. | 347/48 |
| 6,890,063 | B2 * | 5/2005 | Kim | 347/56 |

* cited by examiner

*Primary Examiner*—Manish S. Shah
*Assistant Examiner*—Lisa M. Solomon
(74) *Attorney, Agent, or Firm*—Frishauf, Holtz, Goodman & Chick, P.C.

(57) ABSTRACT

An inkjet head having: an inkjet head chip having ink jetting openings which are lined up to form a nozzle row on a front surface of the inkjet head chip; a manifold attached securely to a side of the inkjet head chip and leading ink to the inkjet head chip; and an ink heater which is in thermal contact through the manifold with ink in the manifold and which varies in heat generation density in a direction of the nozzle row.

17 Claims, 16 Drawing Sheets

INKJET HEAD

BACKGROUND OF THE INVENTION

1. Field of the Invention

The invention relates to an inkjet head which attains desirable images by jetting ink onto a recording medium, and more particularly, to an inkjet head for heating and jetting high viscosity ink.

2. Description of Related Art

An inkjet printer which jets ink onto a recording medium, e.g. a paper, a thin plastic plate or the like, to record a predetermined image has been proposed, and is now in practical use. The inkjet printer, which is equipped with an inkjet head having ink jetting openings, records a predetermined image on a recording medium by jetting ink onto the recording medium while the inkjet head is moved along a predetermined direction.

The inkjet printer jets ink through an inkjet head that utilizes a piezoelectric element. The inkjet head includes an inkjet head chip having ink jetting openings which are lined up to form a nozzle row on a front surface of the inkjet head chip, and a manifold attached securely to a side of the inkjet head chip and leading ink to the inkjet head chip.

However, because the ink used in the inkjet printer becomes high in viscosity when the temperature becomes low, it is required to keep the ink at a predetermined viscosity by heating the ink to decrease the viscosity so that the ink can be well jetted.

In recent years, a method for recording an image by an inkjet printer which uses UV curable ink that hardens when exposed to UV irradiation, has been proposed. But due to the fact that UV curable ink has a higher viscosity than general ink, it is difficult to jet highly viscous ink properly. Actually, an ink jetting method is under development, wherein UV curable ink is jetted, when heated into a low viscosity state, from an inkjet head.

For these reasons, it is well known that an ink heater disposed in an inkjet printer is used to heat ink for purposes of keeping ink at a certain temperature, transforming ink into liquid phase, and so on.

Known as examples of arrangement of ink heaters are: disposing an ink heater in an ink tank; disposing an ink heater for heating the filter case of the inkjet head as described in JP-Tokukaihei-10-790A; and so on.

In JP-Tokukai-2003-165217A, a technique is disclosed, wherein an elongated rod-shaped heater, which is longer than the longitude of a nozzle row, is embedded in a common ink chamber in parallel to the nozzle row with adhesives.

In addition, in JP-Tokukai-2003-136756A, another technique is disclosed, wherein a U-shaped plane heater is embedded in the wall of a common ink chamber while a circular cylindrical heater is disposed inside a common ink chamber.

In JP-Tokukaihei-7-276635A, a third technique is disclosed, wherein a layer having a high thermal conductivity is disposed between an ink heater and an inkjet head so that the ink can be heated equally, even if the ink heater is placed at a position that is inequidistant from each nozzle.

However, in the above mentioned ink heater which is disposed in an ink tank, the ink may change in temperature before being jetted from an ink jetting opening, and therefore the ink may be not well jetted.

In the case of the ink heater for heating the filter case of an inkjet head as described in JP-Tokukaihei-10-790A, it is difficult to vary the amount of heat corresponding to ink temperatures, and this makes it troublesome to maintain the ink at a predetermined temperature. Therefore a poor ink jetting may be caused.

One approach to solve the aforementioned problems is to maintain the ink at a predetermined temperature by heating the ink in the manifold through an ink heater which is disposed on a side portion of the manifold.

However, the ink in the manifold has an area where the temperature tends to be difficult to decrease and an area where the temperature tends to be easy to decrease because the heat dissipating condition in the inkjet head varies from place to place. For example, the temperature at the area around both end sides of the nozzle row tends to be easy to decrease, and the temperature in the area close to the ink inlet opening that flows the ink into the manifold also tends to be easy to decrease.

However, because the ink heater disposed on the side portion of the manifold heats all parts of the manifold in the same manner and the heat generation density is the same regardless of whichever position in the heater, it causes a variation to occur in temperature of the ink in the inkjet head. As a result, a variation in ink viscosity occurs, and therefore the ink droplets may be jetted unequally and a poor image formation may be caused.

A rod-shaped heater embedded with silicon adhesives is described in JP-Tokukai-2003-165217A. In this technique, while silicon resin has a relatively good thermal conductivity, it has difficulty in transferring heat equally from the heater to the ink because the thermal resistance of the adhesives is large, and therefore the heat transfer efficiency is poor. In addition, unlike a plane film type heater, a rod-shaped heater cannot heat the ink equally, because it has a small heat generation surface.

In JP-Tokukai-2003-136756A, a technique in which a plane heater is embedded in the wall of a manifold is disclosed. No concrete manner to embed the heater therein, however, is disclosed. After all, it is difficult to extend a thin plane heater to be even so as to embed it in a surface because it curls up.

SUMMARY OF THE INVENTION

In view of the aforementioned problems, it is therefore an object of the invention to provide an inkjet head that is capable of jetting uniform ink droplets by making uniform the temperature of the ink in the inkjet head, which further enables the ink viscosity to be uniform.

It is another object of the invention to provide an inkjet head which can transfer heat efficiently by integrally molding an ink heater with a manifold without using any adhesives and any high thermal conductivity materials, and eliminate the possibility to increase the manufacturing man-hour and cost, and can heat the ink equally with a simple configuration.

According to a first aspect of the invention, the inkjet head comprises: an inkjet head chip having ink jetting openings which are lined up to form a nozzle row on a front surface of the inkjet head chip; a manifold attached securely to a side of the inkjet head chip and leading ink to the inkjet head chip; and an ink heater which is in thermal contact through the manifold with ink in the manifold and which varies in heat generation density in a direction of the nozzle row.

In accordance with such an inkjet head, it is possible to make uniform the temperature of the ink in the inkjet head.

Such an inkjet head enables the ink viscosity to be uniform, and makes it possible to have an ink jetting with uniform ink droplets. As a result, a satisfactory ink jetting can be obtained, and therefore it is possible to have a satisfactory image formation.

In this case, preferably, the ink heater increases in heat generation density on both end sides of the nozzle row.

In accordance with such an inkjet head, it is possible to increase the temperature of the ink on both end sides of the nozzle row where heat is prone to dissipate, and therefore it is possible to obtain a uniform temperature of the ink in the inkjet head.

Such an inkjet head enables the ink viscosity to be uniform, and enables to have an ink jetting with uniform ink droplets. As a result, a satisfactory ink jetting can be obtained, and therefore it is possible to have a satisfactory image formation.

In addition, the ink heater is preferably provided with a heating wire that is formed into waveforms, and a change in the number of the waveforms of the heating wire with respect to a predetermined area causes a change in the heat generation density accordingly.

In accordance with such an inkjet head, it is possible to have a uniform temperature of the ink in the inkjet head with a simple configuration.

Such an inkjet head enables the ink viscosity to be uniform, and enables to have an ink jetting with uniform ink droplets. As a result, a satisfactory ink jetting can be obtained, and therefore it is possible to have a satisfactory image formation.

In this case, preferably, the ink heater increases in heat generation density on both end sides of the nozzle row.

In accordance with an inkjet head, it is possible to increase the temperature of the ink in both end sides of the nozzle row where heat is prone to dissipate, and therefore it is possible to obtain a uniform temperature of the ink in the inkjet head.

Such an inkjet head enables the ink viscosity to be uniform, and enables to have an ink jetting with uniform ink droplets. As a result, a satisfactory ink jetting can be obtained, and therefore it is possible to have a satisfactory image formation.

Preferably, the ink heater is embedded in a wall of the manifold.

In accordance with such an inkjet head, it is possible to incorporate the ink heater in the inkjet head only with a conventional manufacturing process of mounting a manifold.

Such an inkjet head eliminates the need to increase the manufacturing man-hour and cost, and enables to heat the ink equally with a simple configuration.

In this case, the ink heater is preferably integrally molded with the manifold.

In accordance with such an inkjet head, it is possible to efficiently transfer the heat from the ink heater to the entire manifold.

Such an inkjet head enables to efficiently heat the ink in the manifold in a uniform manner.

Preferably, the ink heater is disposed on a side of the manifold, which is opposite to a side securely attached to the inkjet head chip.

In accordance with such an inkjet head, it is possible to attach the ink heater by merely going through a simple process.

Such an inkjet head enables to have a uniform temperature of the ink without going through a complex process.

In this case, preferably, the inkjet head further comprises a case frame to hold the manifold, and the ink heater is arranged between the manifold and the case frame.

In accordance with such an inkjet head, it is possible to attach the ink heater by merely going through a simple process. In addition, the heat from the ink heater, while accounts for only one portion, is transferred through adhesives to the case frame, a good thermal conductor. This causes the case frame to store a certain amount of heat, and subsequently to serve as a heat buffer.

Such an inkjet head enables to have a uniform temperature of the ink without going through a complex process.

Preferably, the inkjet head is provided with: an inkjet head chip which has a plurality of nozzle rows; a plurality of manifolds which are positioned symmetrically with respect to an plane of the inkjet head chip; an ink heater which is installed in each of the manifolds.

In accordance with such an inkjet head, it also allows the inkjet head provided with an inkjet head chip having a plurality of nozzle rows to make uniform the temperature of the ink in the inkjet head.

Such an inkjet head enables the ink viscosity to be uniform, and enables to have an ink jetting with uniform ink droplets. As a result, a satisfactory ink jetting can be obtained, and therefore it is possible to have a satisfactory image formation.

In this case, preferably, the ink heater increases in heat generation density on both end sides of the nozzle row.

In accordance with such an inkjet head, it is possible to increase the temperature of the ink in both end sides of the nozzle row where heat is prone to dissipate, and therefore it is possible to obtain a uniform temperature of the ink in the inkjet head.

Such an inkjet head enables the ink viscosity to be uniform, enables to have ink jetting with uniform ink droplets. As a result, a satisfactory ink jetting can be obtained, and therefore it is possible to have a satisfactory image formation.

In addition, the ink heater is preferably provided with a heating wire that is formed into waveforms, and a change in the number of the waveforms of the heating wire with respect to a predetermined area causes accordingly a change in the heat generation density.

In accordance with such an inkjet head, it is possible to have a uniform temperature of the ink in the inkjet head with a simple configuration.

Such an inkjet head enables the ink viscosity to be uniform, and enables to have ink jetting with uniform ink droplets. As a result, a satisfactory ink jetting can be obtained, and therefore it is possible to have a satisfactory image formation.

In this case, preferably, the ink heater increases in heat generation density on both end sides of the nozzle row.

In accordance with such an inkjet head, it is possible to increase the temperature of the ink in both end sides of the nozzle row where heat is prone to dissipate, and therefore it is possible to obtain a uniform temperature of the ink in the inkjet head.

Such an inkjet head enables the ink viscosity to be uniform, and enables to have an ink jetting with uniform ink droplets. As a result, a satisfactory ink jetting can be obtained, and therefore it is possible to have a satisfactory image formation.

According to a second aspect of the invention, the inkjet head comprises an ink supply inlet opening to supply ink into a manifold; and an ink heater to heat supplied ink and to increase in heat generation density in a vicinity of the ink supply inlet opening.

In accordance with such an inkjet head, it is possible to increase the temperature of the ink in the vicinity of the ink supply inlet opening where heat is prone to dissipate, and therefore it is possible to obtain a uniform temperature of the ink in the inkjet head.

Such an inkjet head enables the ink viscosity to be uniform, and enables to have ink jetting with uniform ink droplets. As a result, a satisfactory ink jetting can be obtained, and therefore it is possible to have a satisfactory image formation.

According to a third aspect of the invention, the inkjet head comprises: an inkjet head chip having a plurality of channels for generating a change in pressure which is applied to ink and for jetting ink from corresponding ink jetting openings which are formed in parallel to each other; a manifold attached to the inkjet head chip and forming a common ink chamber to distribute ink to each of the channels; and an ink heater embedded in the manifold and being in thermal contact with ink in the common ink chamber.

In accordance with such an inkjet head, the ink heater that is in thermal contact with the ink in the common ink chamber is embedded in the wall of the manifold, and therefore it is possible to incorporate the ink heater in the inkjet head just with a conventional manufacturing process of mounting a manifold.

Such an inkjet head eliminates the need to increase the manufacturing man-hour and cost, and enables to heat the ink equally with a simple configuration.

In this case, preferably, the ink heater is integrally molded into the manifold.

In accordance with such an inkjet head, it is possible to efficiently transfer the heat from the ink heater to the entire manifold.

Such an inkjet head enables to efficiently heat the ink in the manifold in a uniform manner.

In this case, preferably, the ink heater is integrally molded with the manifold by injection molding.

In accordance with such an inkjet head, it is possible to easily produce the ink heater that is embedded in the inner wall of the manifold.

In addition, the ink heater is preferably a film type heater.

In accordance with such an inkjet head, the ink heater is the film type heater, which allows it to be easily embedded in the manifold, and which at the same time eliminates the need for a manifold that is of macro-scale, and therefore further eliminates the need for an inkjet head that is of macro-scale. In addition, the film type heater, when compared with one that is of rod shape, is much more effective in heating ink equally.

BRIEF DESCRIPTION OF THE DRAWINGS

The invention will become more fully understood from the detailed description given hereinbelow and the accompanying drawings which are given by way of illustrating only, and thus are not intended as a definition of the limits of the invention, and wherein.

DETAILED DESCRIPTION OF THE PREFERRED EMBODIMENTS

The invention will become more fully understood from the detailed description given hereinbelow and the accompanying drawings which are given by way of illustrating only, and thus are not intended as a definition of the limits of the invention.

First Embodiment

Figure 1:
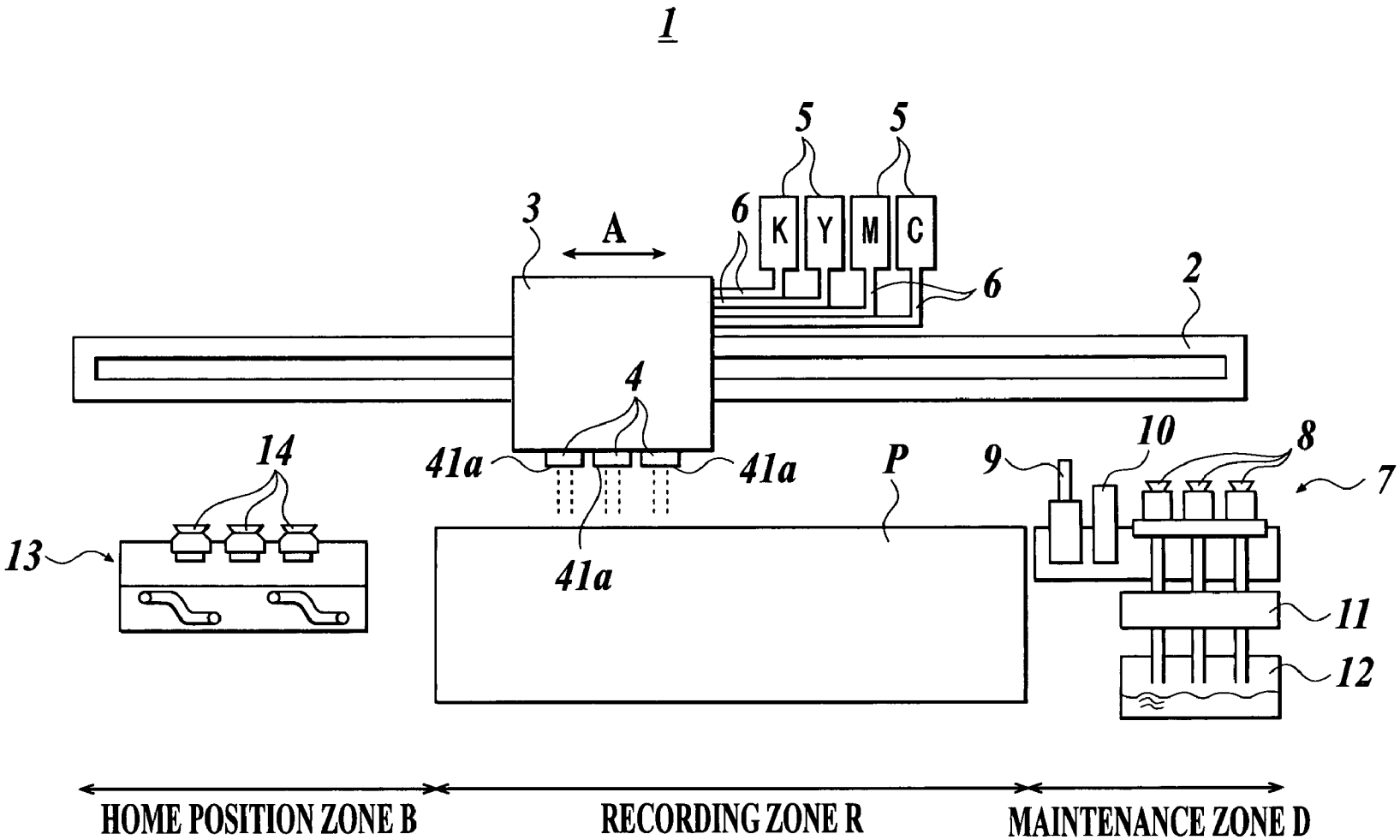
FIG. 1 is a schematic plane view illustrating an inkjet printer in accordance with a first embodiment of the invention.

With reference to FIG. 1, the entire configuration of the inkjet printer in accordance with the first embodiment of the invention will be explained as follows. FIG. 1 illustrates the entire configuration of the inkjet printer in accordance with the first embodiment of the invention.

An inkjet printer 1 is an apparatus that records images on a recording medium P whereto ink is jetted. The inkjet printer 1 is equipped with a certain conveying expedient which is not shown in the figure, and which conveys the recording medium P in a secondary scanning direction that is perpendicular to a main scanning direction A while passing through a recording zone R.

A carriage rail 2 that extends along the horizontal scanning direction A is positioned on the upper side of recording zone R. A freely movable carriage 3, steered by the carriage rail 2, is disposed on the carriage rail 2.

The carriage 3 which is loaded with an inkjet head 4 for jetting ink onto recording medium P, moves so that in the direction of arrow A alongside of carriage rail 2 from a home position zone B to a maintenance zone D.

Four inkjet heads 4 which make it possible to jet four kinds of colors, i.e. Cyan, Magenta, Yellow and Black, are set up in the carriage 3. Two of the inkjet heads are lined up in back and forth direction; the other two are situated symmetrically with respect to the central point of the line that joins the back-and-forth aligned two.

Ink tanks 5 that store ink in colors of Cyan, Magenta, Yellow and Black are linked to each of the inkjet heads 4 through ink feeding pipes 6. In other words, ink in the ink tanks 5 is supplied to each of the inkjet heads 4 through the ink feeding pipes 6.

A maintenance unit 7 is set up in the maintenance zone D for carrying out the maintenance of the inkjet heads 4. The maintenance unit 7 consists of: a plurality of suction caps 8 that cover up jetting surfaces 41*a* of the inkjet heads 4 for sucking ink from nozzles; a blade 9 for wiping off ink that clings to the jetting surfaces 41*a*; an ink collecting container 10 that gathers ink evacuated from the inkjet heads 4; a suction pump 11; and a waste ink tank 12. The suction caps 8 are in communication with the waste ink tank 12 through the suction pump 11. And when maintenance is in operation, the suction caps 8 rise so as to cover up the jetting surfaces 41*a* of the inkjet heads 4. Four suction caps 8 are arranged corresponding to each of the inkjet heads 4 so as to cover up the jetting surfaces 41*a* of all the inkjet heads 4 when arising in the aforementioned manner.

With the suction caps 8 covering up the jetting surfaces 41*a*, the suction pump 11, either being a cylindrical pump or being a tube pump, is actuated so as to generate a suction force that sucks ink as well as contaminants from ink jetting openings 421 (to be under mentioned).

A moisture retention unit 13 is set up in the home position zone B for keeping the moisture of the inkjet heads 4. And disposed in the moisture retention unit 13 are four moisture retention caps 14 that keep moisture of the inkjet heads 4 by, when the inkjet heads 4 are on standby, covering up the jetting surfaces 41*a*. These four moisture retention caps 14 are arranged corresponding to the layout of the inkjet heads 4 so as to simultaneously cover up the jetting surfaces 41*a* of the four inkjet heads 4.

A control unit which comprises CPU (Central Processing Unit) and memory is set up to control each component of the inkjet printer 1. Data for forming image on the recording medium P and programs for controlling each component of the inkjet printer 1 are stored in the memory. Control signals are transmitted to each component based on the image data and programs in the memory.

Next, with reference to FIGS. 2–6, the inkjet head 4 in accordance with the first embodiment of the invention will be explained as follows.

Figure 2:
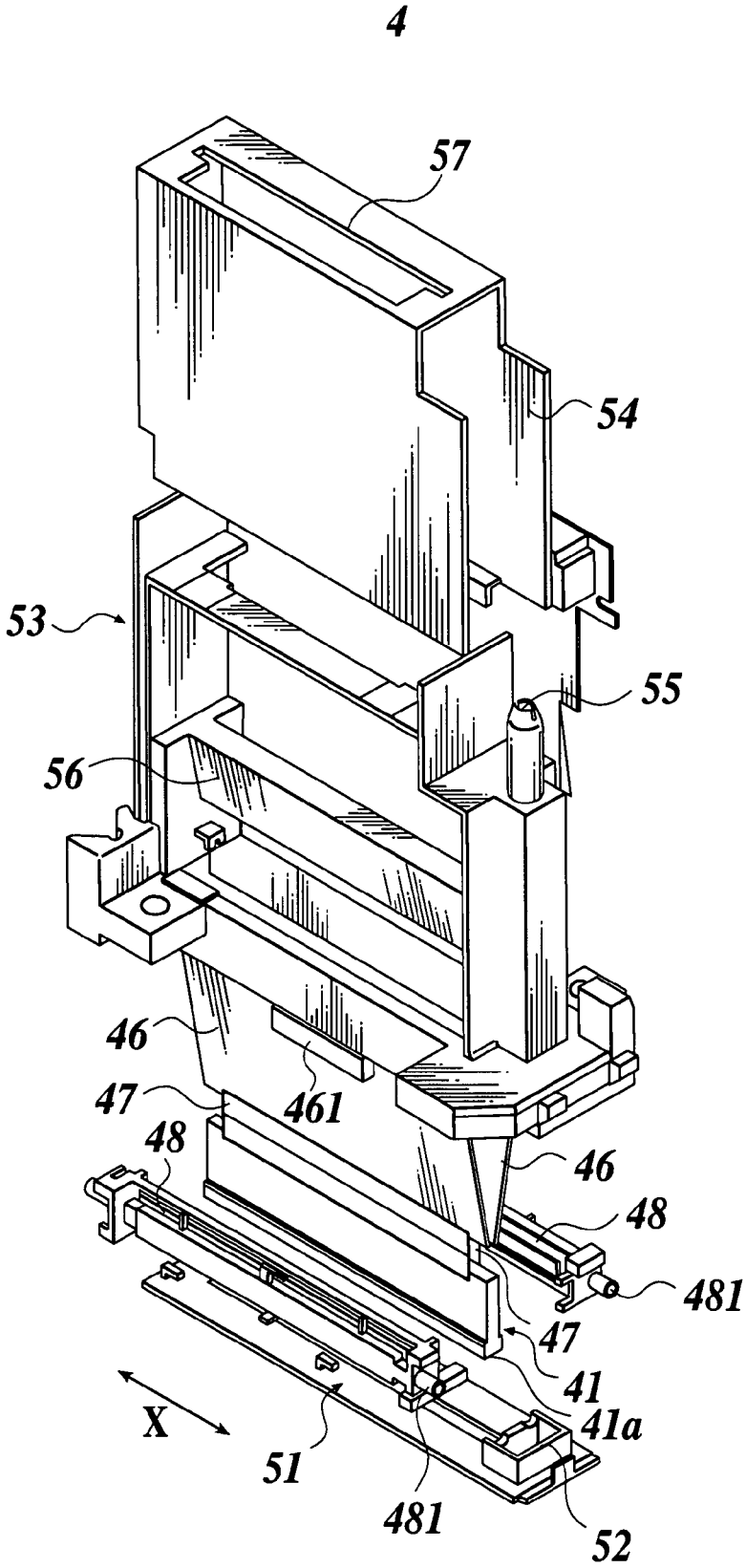
FIG. 2 is an exploded perspective view of an inkjet head in accordance with the first embodiment of the invention.
Figure 3:
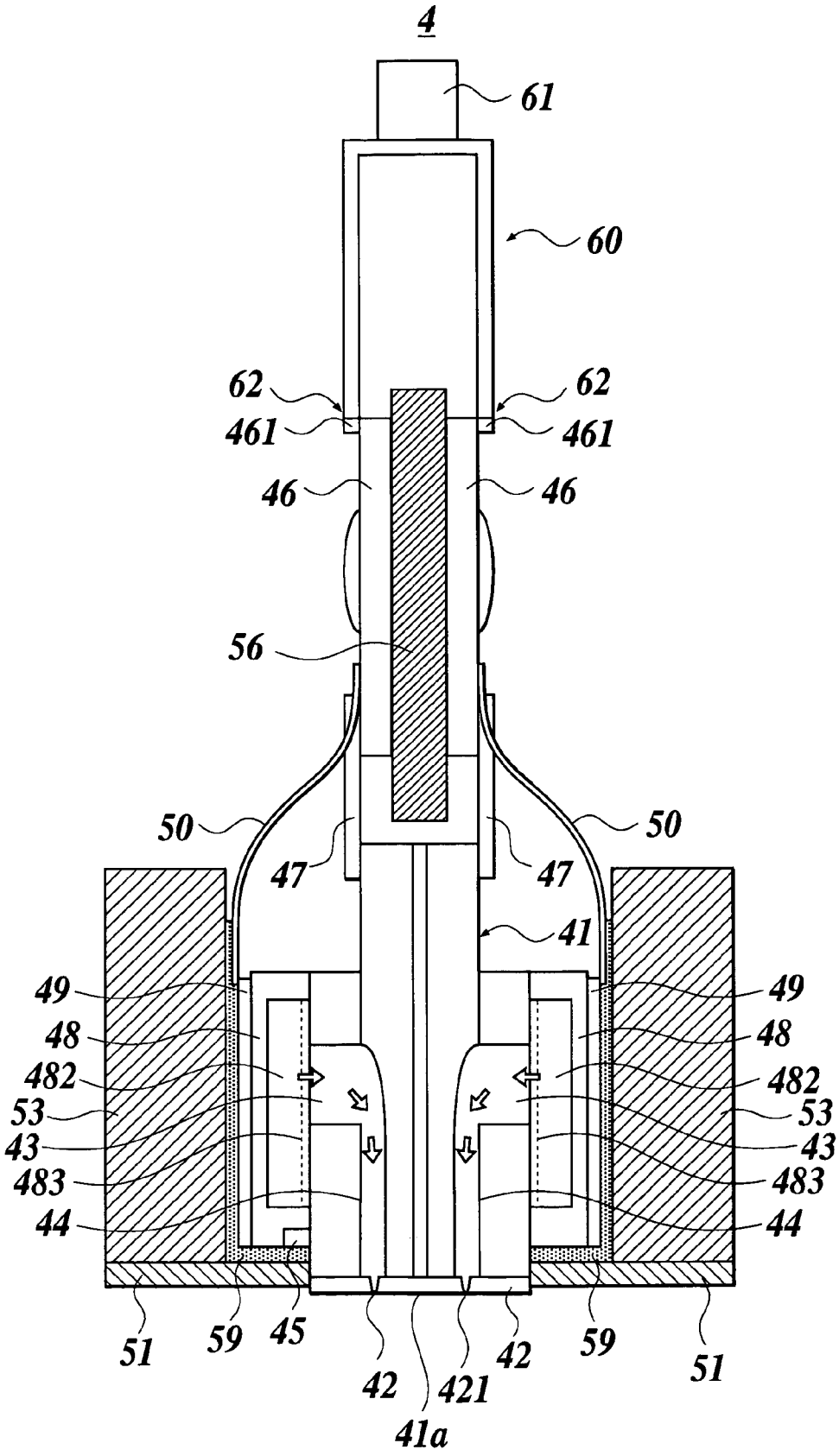
FIG. 3 is a side view of the inkjet head in accordance with the first embodiment of the invention.
Figure 4:
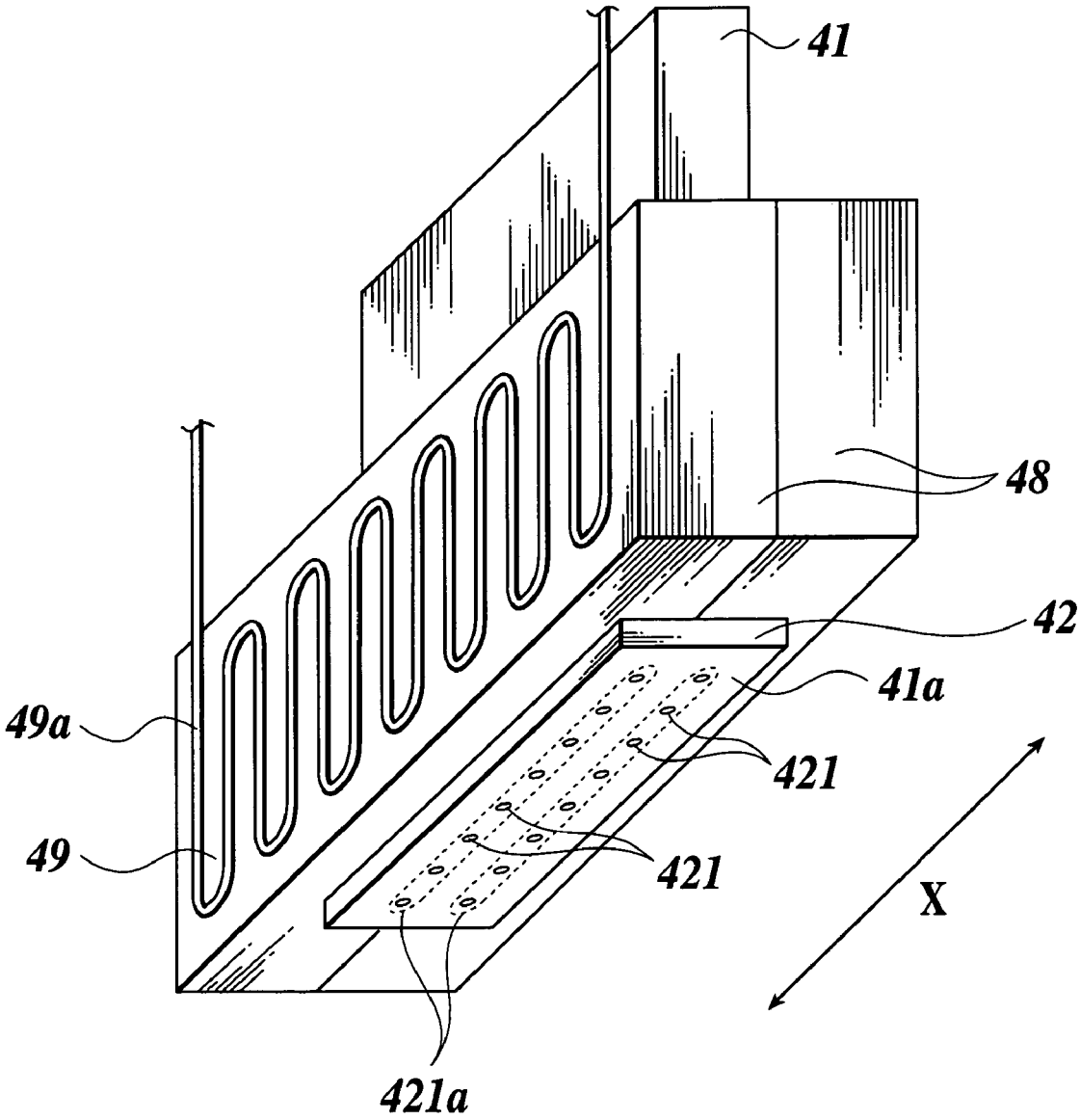
FIG. 4 is an enlarged perspective view of an inkjet head chip of the inkjet head and a vicinity of a manifold, in accordance with the first embodiment of the invention.
Figure 5:
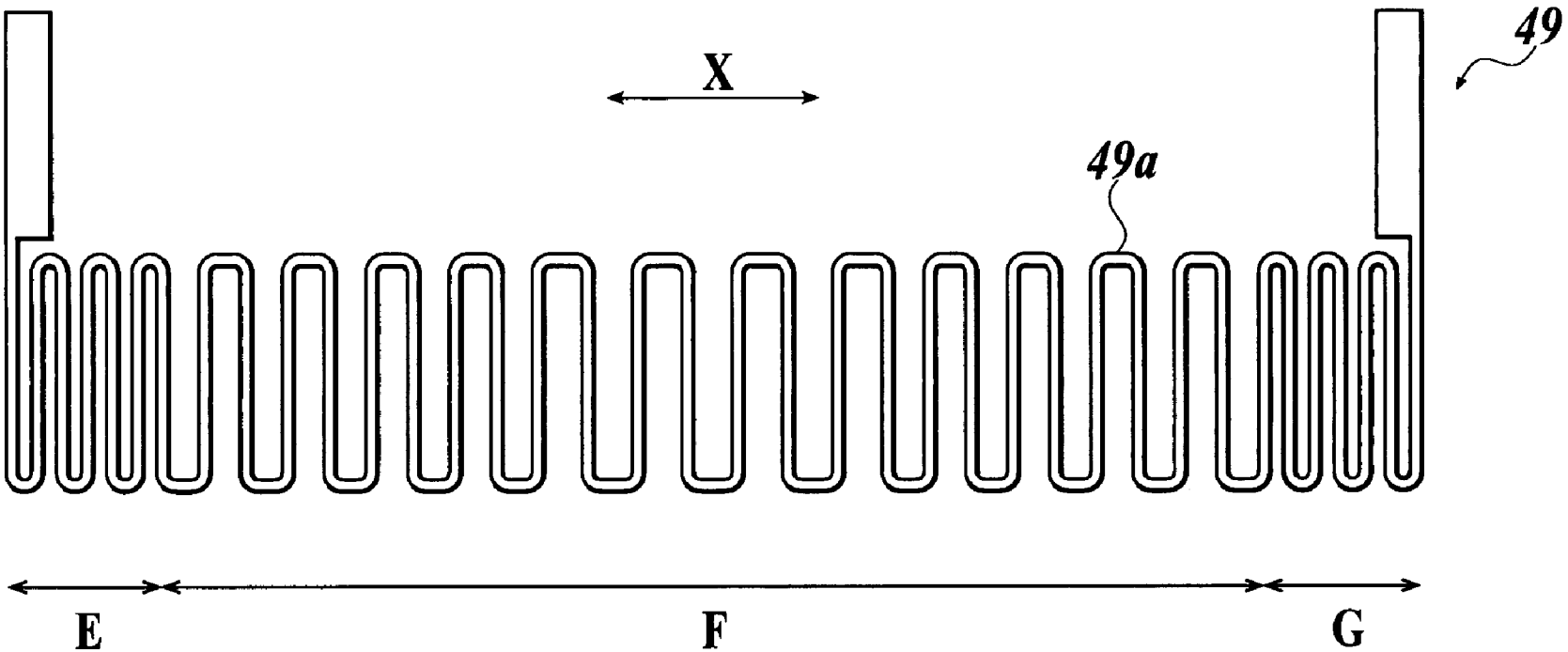
FIG. 5 is a view illustrating a layout example of a heating wire in an ink heater.
Figure 6:
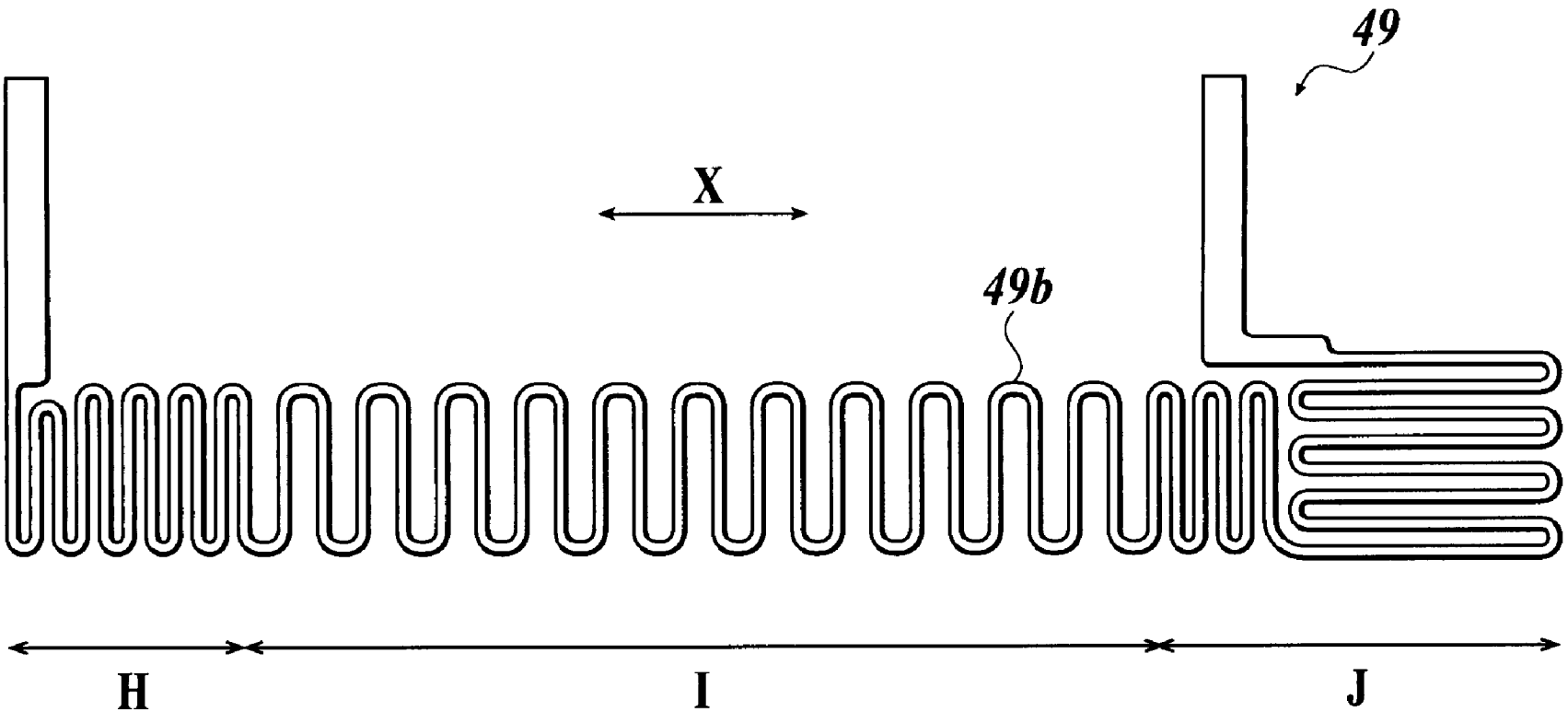
FIG. 6 is a view illustrating another layout example of the heating wire in the ink heater.

FIG. 2 is the exploded perspective view of the inkjet head in accordance with the embodiment. FIG. 3 is the side view of the inkjet head in accordance with the embodiment. FIG. 4 is the enlarged perspective view of the inkjet head chip of the inkjet head, and of the vicinity of the manifold, in accordance with the embodiment. FIG. 5 illustrates the exemplary layout of the heating wire in an ink heater 49. FIG. 6 illustrates another exemplary layout of the heating wire in the ink heater 49.

The inkjet head 4 in accordance with the embodiment is provided with an inkjet head chip 41 for jetting ink. The inkjet head chip 41 is of a long ruler shape when seen from the direction of arrow X and has a nozzle plate 42 where a plurality of ink jetting openings are aligned on the jetting surface (front surface) thereof in the direction of arrow X. A nozzle row 421*a* is a row of nozzles that consists of ink jetting openings 421 made in succession in the direction of arrow X. In the embodiment, two nozzle rows 421*a* are provided in the inkjet head 4. The inkjet head 4 is so loaded into the carriage 3 that the arrow direction X (the direction of the nozzle row) is perpendicular to the main scanning direction A of FIG. 1.

As shown in FIG. 3, an ink supply opening 43 is disposed on both side portions of the inkjet head chip 41 in such a manner that it is in communication with the ink jetting opening 421 through an ink flow passage 44 which is formed inside the inkjet head chip 41. One portion of the ink flow passage 44 forms a pressure chamber (channel) in such a way that a change in pressure by a piezoelectric element that is not shown in the figure causes ink droplets to be jetted from the ink jetting opening 421.

Two manifolds 48, which connect to the ink supply opening 43 and which lead ink coming from outside to the inkjet head 41, are positioned symmetrically with respect to a plane of the inkjet head chip 41 and are securely fixed on both side portions of the inkjet head chip 41. One end side of the manifold 48 is perforated with an ink inlet opening 481 (Refer to FIG. 2), from where ink is directed inward.

The manifold 48 houses a common ink chamber 482. The common ink chamber 482 is situated in such a manner that its aperture is opposite to the ink supply opening 43 and at the same time it is in communication with the ink supply opening 481. In addition, an ink filter 483 for filtering out impurities from the ink is disposed in the aperture of the common ink chamber 482. The ink coming from outside first passes through the ink supply opening 481, and then flows into the common ink chamber 482 that is inside the manifolds 48. After passing through the ink filter 483, the ink is directed to the interior of the inkjet head chip 41 from the ink supply opening 43 before finally being jetted from the ink jetting opening 421. Between each of the two manifolds 48 and the case frame 53, the ink heater 49 is disposed on the side portion (i.e. in each of the manifolds 48, the side portion which is opposite to a side securely attached to the inkjet head chip 41) of the manifold 48 in such a manner so that the ink heater 49 is in contact with the manifold 48. In addition, the ink heater 49 is in thermal contact with the ink directed to the interior of the manifold 48 through the manifold 48, and is set up so as to heat the ink to a predetermined temperature.

In addition, an adhesive 59 is so filled in the space between the manifold 48 and the case frame 53 that at least the ink heater 49 is surrounded, which allows the case frame 53, to be securely fixed to the ink heater 49 and the manifold 48.

It is often the case that the manifold 48 is made of resin while the case frame 53 is made of such materials as metal. For this reason, most of the heat generated from the ink heater 49 is generally transferred to the case frame 53. By contrast, according to the present invention, the adhesive 59 is used to fill the cavity between ink heater 49 and the case frame 53, suppressing the heat transferred from the ink heater 49 to the case frame 53, which further makes it possible to transfer heat from the ink heater 49 to the ink in the manifold 48 in a reasonable manner.

The ink heater 49 of the embodiment is built of an appropriate sheet where a heating wire 49*a* formed into waveforms is placed on.

The ink heater 49 is so formed that it varies in heat generation density per unit length in the nozzle row direction X. The heat generation density is so varied as to, in the embodiment, result from a change in the number of waveforms of the heating wire 49*a* in ink heater 49 with respect to a predetermined area. More specifically, the number of waveforms per unit area with respect to the heating wire 49*a* on both lateral sides of the nozzle row 421*a* is increased in such a manner that the heat generation density on both end sides of the nozzle row 421*a* (i.e. left end side E and right end side G along the nozzle row direction X) is larger than that on the central section of the nozzle row 421*a* (i.e. central section F along the nozzle row direction X), which further makes it possible to increase the temperature of the ink, particularly on both end sides of the nozzle row where heat is prone to dissipate.

In addition, it is desirable to have a homogeneous thermal coupling between the ink heater 49 and the manifold 48 in order to heat ink homogeneously through the ink heater 49 and the manifold 48. To this end, the ink heater 49 and the manifold 48 can be in contact with each other through a specific component. Additionally, instead of the specific component, an adhesive of a certain amount can be used to fill the space between the ink heater 49 and the manifold 48.

As shown in FIG. 3 and FIG. 4, the ink heater 49 is disposed in such a position so that it is in thermal contact with the manifold 48, not only with direct contact but also using adhesive material; nevertheless, the ink heater 49 can be situated apart from the manifold 48.

In addition, the ink heater 49 can be positioned on both lateral sides of the manifold 48 respectively, or on any one side only of the manifold 48.

Furthermore, as shown in FIG. 6, it is also allowable to have such a layout position for the ink heater 49, wherein the number of waveforms per unit area with respect to the section of the heating wire 49*b* that is close to the ink inlet opening 481 is particularly increased so that the heat generation density on the side (the right end side J of the nozzle row direction X) close to the ink inlet opening 481 that supplies ink to the common ink chamber 482 which is inside the manifold 48 of the inkjet head 4 becomes particularly large. As shown in FIG. 6, the number of waveforms per unit area with respect to the left end side H of the heating wire 49*b* in the nozzle row direction X is increased than that with respect to the central section I in the nozzle row direction X. This makes it possible to increase the temperature of the ink that is close to the ink inlet opening 481 where heat is prone to dissipate due to the cooling effect by the ink flow.

The right side in both FIG. 5 and FIG. 6 corresponds respectively to the right anterior side in FIG. 4 and the right topside in FIG. 2.

Two sets of the inkjet head driving substrates 46, which transmit control signals from a control unit of the inkjet head chip 41 to each piezoelectric element that is not shown in the figure, are connected respectively through a flexible patch board 47. On the inkjet head driving substrate, formed is a heater circuit which supplies electric power to the ink heater 49, and to which the heating wire 49*a* of the ink heater 49 is electrically connected through an electric wire 50. And a temperature sensor 45 for detecting temperature is also electrically connected to the heater circuit in the same manner through an electric wire that is not shown in the figure. The temperature sensor 45 is disposed closer to the inkjet head chip 41 than to the ink heater 49.

Connectors 461 are disposed respectively on the two sets of the inkjet head driving substrates 46. An output terminal 62 of a flexible patch board 60 having one input terminal 61 and two output terminals 62, is connected to each of the connectors 461. The power supply and control unit, while both of which are not shown in the figure, are electrically connected to the input terminal 61 of the flexible patch board 60 so that control signals and electricity are supplied to the inkjet head driving substrate 46.

A supporting board 51 for supporting the manifold 48 and the inkjet head chip 41 is attached to the lower part of the inkjet head chip 41 so that the jetting surface 41*a* comes to be outside exposed. An ink receiving section 52 for supporting the ink inlet opening 481 of the manifold 48 and for pouring ink into the ink inlet opening 481 is formed on one end side of the supporting board 51.

As shown in FIG. 2, components of the inkjet head 4 such as the inkjet head chip 41, the manifold 48, the inkjet head driving substrate 46 and the supporting board 51 are mounted in the inkjet head 4. A case frame 53 for storing and fixing, and a cover 54 for covering up the case frame 53 are also disposed in the inkjet head 4. A frame ink flow passage 55 which is connected to the ink receiving section 52 of the supporting board 51 for supplying ink is disposed in the case frame 53, and an ink supply pipe 6 is so positioned that it is connected to the frame ink flow passage 55. Besides, a supporting beam 56 is disposed inside the case frame 53 for supporting the two sets of inkjet head driving substrates 46. On the top of the cover 54 is so perforated with an aperture 57 that from which the input terminal 61 of the flexible patchboard 60 comes to be outside exposed after the inkjet head 4 is assembled.

The advantageous effect of the embodiment will be explained in the following.

On turning on the power of the inkjet printer 1, electric power is supplied to each component of the inkjet printer 1, and at the same time if electric power is also supplied to the ink heater 49, the electric heating wire 49*a* of the ink heater 49 will start to generate heat, which allows the ink inside the manifold 48 to be heated through the manifold 48, and consequently to form into a low viscosity state.

Afterwards, on inputting a command to record images, the image recording process then starts with the control unit sending control signals based on image data to the inkjet head driving substrate 46 and other actuators. Ink is jetted from the inkjet head 4 onto the recording medium P that is conveyed through a certain conveying expedient, and at this ink jetting stage, the ink is heated in advance and becomes low viscosity, resulting in a stable ink jetting, which further allows high quality images to be formed.

Experimental results of the ink temperatures between the ink heater 49 which has a layout pattern of the electric heating wire 49, and the ink heater which has a conventional layout pattern of an electric heating wire (i. e. a uniform layout where the number of waveforms per unit area is the same regardless of individual positions) are compared. In this experiment, an inkjet head which has a longitude, the length in the nozzle row direction, of 42 mm is used, and heating power is applied to a specific ink heater.

Figure 7:
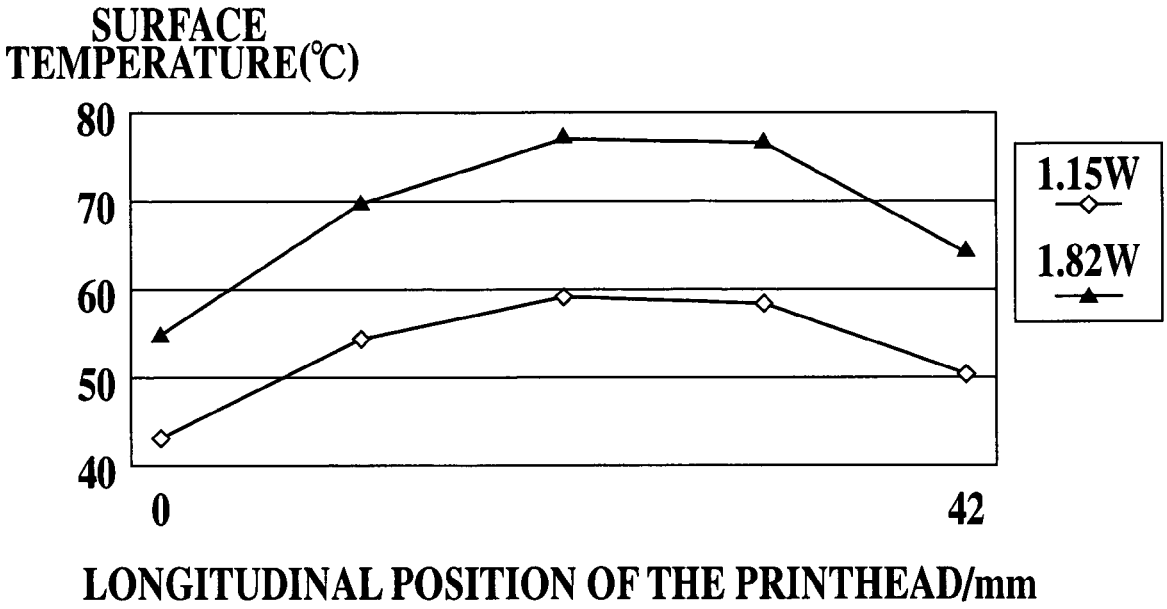
FIG. 7 is a graph that depicts a temperature distribution at each position in a direction of a nozzle row of a front surface where ink jetting openings are disposed according to a conventional ink heater.

FIG. 7 shows the temperature distribution at each position in the direction of the nozzle row on a front surface where ink jetting openings are disposed according to the conventional ink heater.

Figure 8:
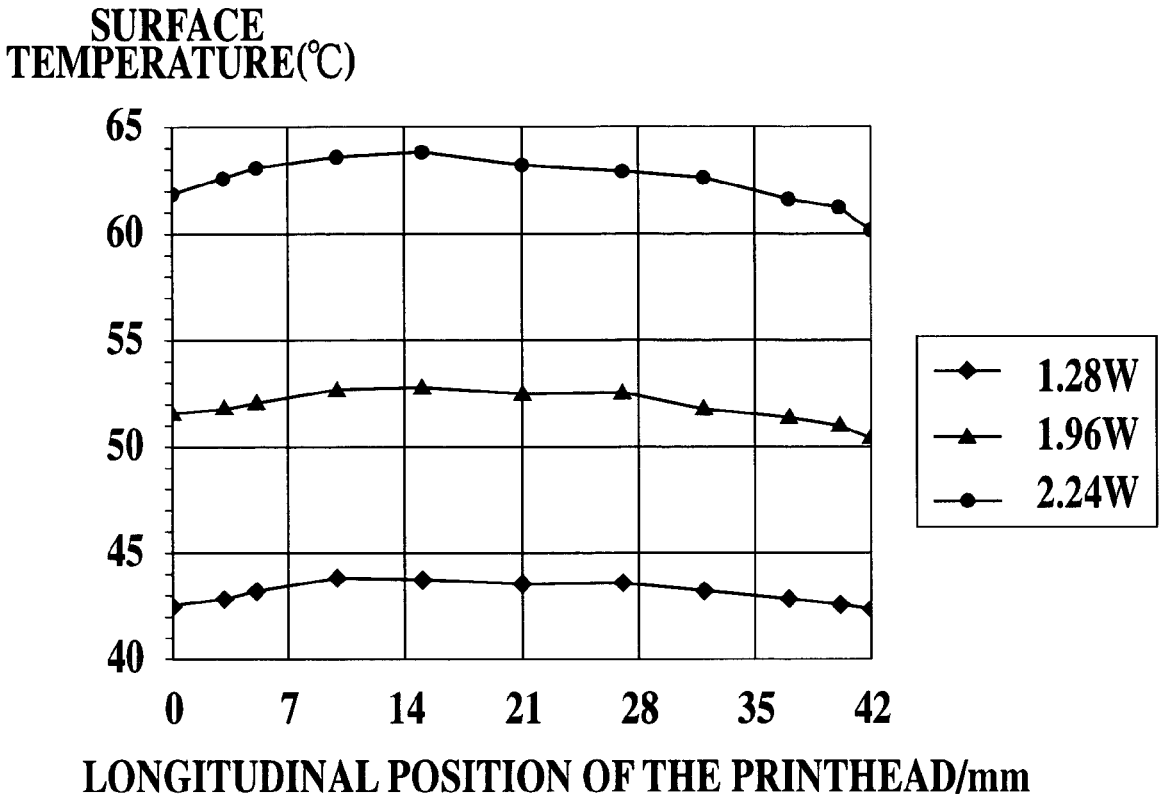
FIG. 8 is a graph that shows a temperature distribution at each position in a direction of the nozzle row of the front surface where ink jetting openings are disposed according to an ink heater of the invention.

FIG. 8 shows the temperature distribution at each position in the direction of the nozzle row on the front surface 41*a* where ink jetting openings 421 are disposed according to the ink heater 49 of the invention as in FIG. 5.

From FIG. 7 and FIG. 8, it is apparent that the ink heater 49 in the invention having a layout pattern of the heating wire is able to homogeneously heat the ink in the inkjet head in comparison with the conventional one.

In accordance with the inkjet head of the embodiment, the inkjet head includes: an inkjet head chip having ink jetting openings which are lined up to form a nozzle row on a front surface of the inkjet head chip; a manifold attached securely to a side of the inkjet head chip and leading ink to the inkjet head chip; and an ink heater which is in thermal contact through the manifold with ink in the manifold and which varies in heat generation density in a direction of the nozzle row. Therefore it is possible to make uniform the temperature of the ink in the inkjet head.

Such an inkjet head enables the ink viscosity to be uniform, and enables to have an ink jetting with uniform ink droplets. As a result, a satisfactory ink jetting can be obtained, and therefore it is possible to have a satisfactory image formation.

In addition, in the embodiment, the ink heater is provided with the heating wire that is formed into waveforms, and a change in the number of the waveforms of the heating wire with respect to a predetermined area causes a change in heat generation density accordingly. Therefore it is possible to achieve the above advantageous effect with a simple configuration.

Also, in the embodiment, the ink heater increases in heat generation density on both end sides of the nozzle row. Such an inkjet head enables to increase the temperature of the ink on both end sides of the nozzle row where heat is prone to dissipate. Therefore it is possible to obtain a uniform temperature of the ink in the inkjet head.

Furthermore, in accordance with the embodiment, the ink heater is disposed on a side of the manifold, which is opposite to a side securely attached to the inkjet head chip. Therefore it is possible to attach the ink heater by merely going through a simple process.

Such an inkjet head enables to have a uniform temperature of the ink without going through a complex process.

Also in accordance with the embodiment, the inkjet head further comprises a case frame to hold the manifold, and the ink heater is arranged between the manifold and the case frame. Therefore it is possible to attach the ink heater by mere going through a simple process. In addition, the heat from the ink heater, while accounts for only one portion, is transferred through adhesives to the case frame, a good thermal conductor. This causes the case frame to store a certain amount of heat, and subsequently to serve as a heat buffer.

Such an inkjet head enables to have a uniform temperature of the ink without going through a complex process.

Also in accordance with the embodiment, the inkjet head chip has a plurality of nozzle rows, the inkjet head comprises a plurality of manifolds which are positioned symmetrically with respect to a plane of the inkjet head chip, and the ink heater is provided in each of the manifolds. This also allows the inkjet head equipped with an inkjet head chip having a plurality of nozzle rows to make uniform the temperature of the ink in the inkjet head.

Also in accordance with such an inkjet head, the inkjet head comprises: an ink supply inlet opening to supply ink into a manifold; and an ink heater to heat supplied ink and to increase in heat generation density in a vicinity of the ink supply inlet opening. Therefore it is possible to increase the temperature of the ink in the vicinity of the ink supply inlet opening where heat is prone to dissipate, and therefore it is possible to obtain a uniform temperature of the ink in the inkjet head.

Such an inkjet head enables the ink viscosity to be uniform, and therefore it is possible to have an ink jetting with uniform ink droplets. As a result, a satisfactory ink jetting can be obtained, and therefore it is possible to have a satisfactory image formation.

In addition, not only the aforementioned exemplary embodiment, but also other configuration can be applied to the inkjet head and the inkjet printer of the invention. For example, the inkjet head is not confined to have a configuration of piezoelectric elements for the inkjet head chip, for instance, the head can also has a configuration of an ink heater for the inkjet head chip.

Also, it is possible to configure the shape and the layout position of the inkjet head and the ink heater appropriately in practice. For example, in order to vary the ink heater in heat generation density, not only the number of the waveforms of the heating wire can be made to change, but also the effective winding number of the ink heater can also be made to change. Additionally, a thin film type heater can be used as the ink heater, and in this case the distribution of the thermal resistance of the film type heater is varied. Therefore the heat generation density will vary accordingly.

And also as one of the layout configuration for the ink heater, which will be under mentioned in the second embodiment, the ink heater can be embedded in the wall of the manifold that forms a common ink chamber. Therefore the same advantageous effect can also be achieved. And furthermore, the heating wire can be obtained by etching a thin metallic plate in accordance with predetermined shape pattern.

Second Embodiment

The inkjet head in accordance with the second embodiment of the invention will be explained in the following.

Figure 9:
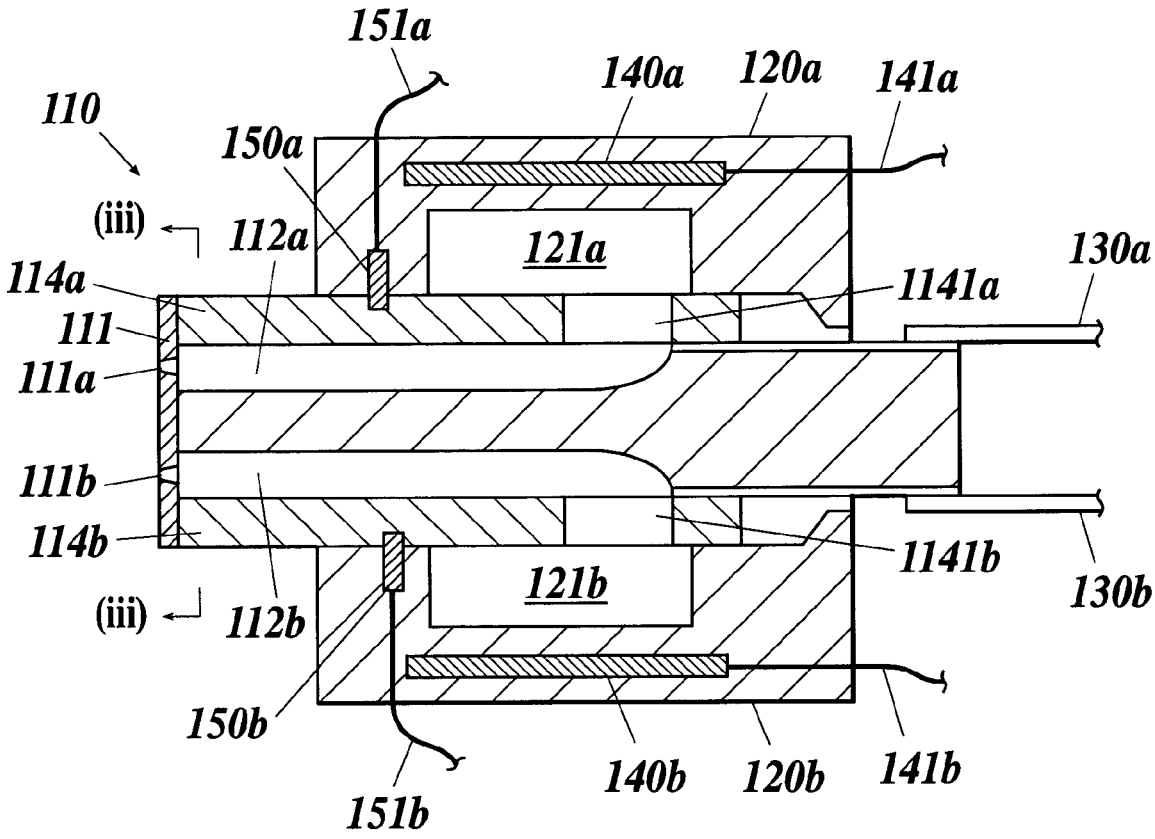
FIG. 9 is a cross sectional view of an inkjet head in accordance with a second embodiment of the invention.
Figure 10:
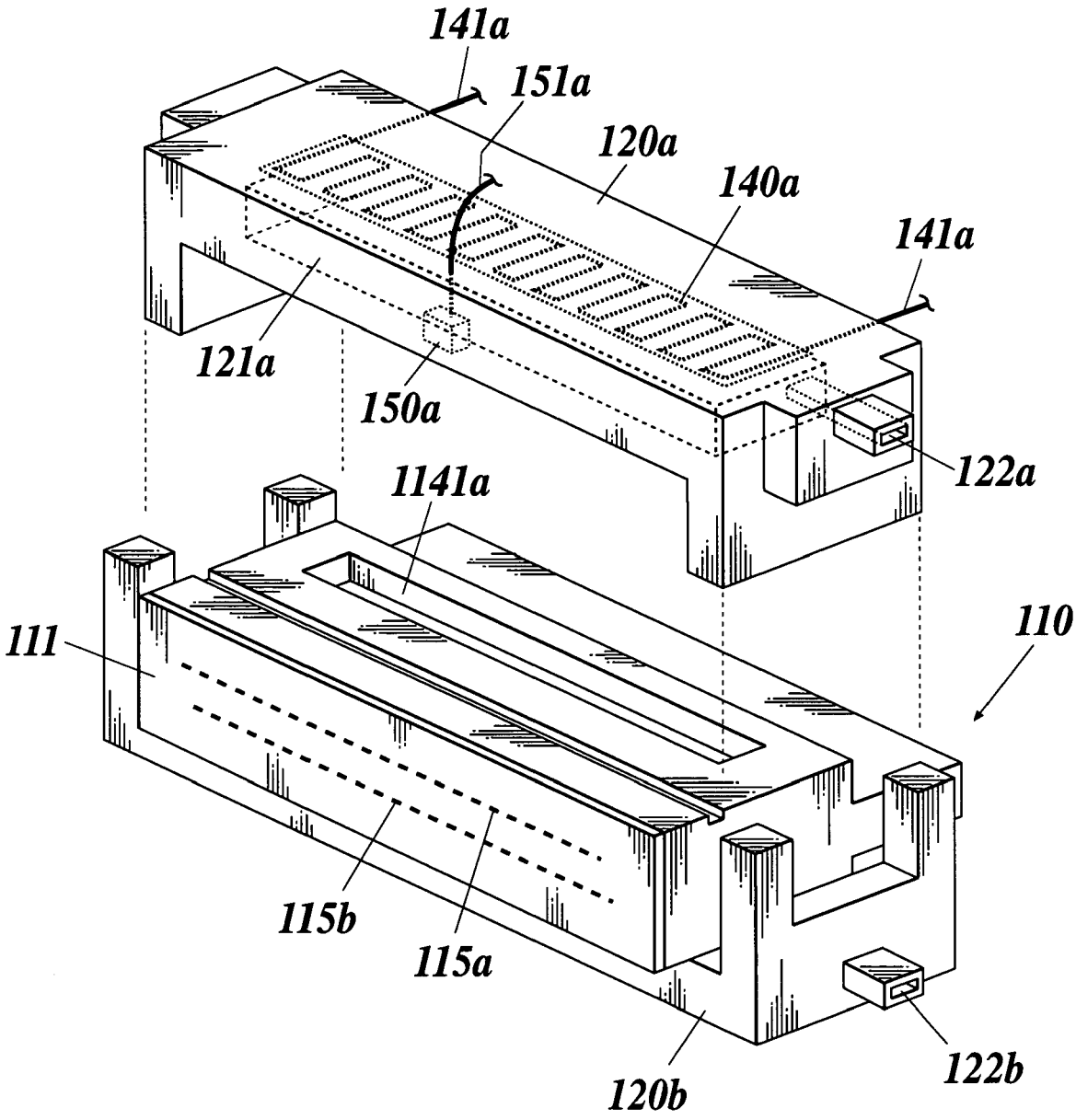
FIG. 10 is an exploded perspective view of FIG. 9.
Figure 11:
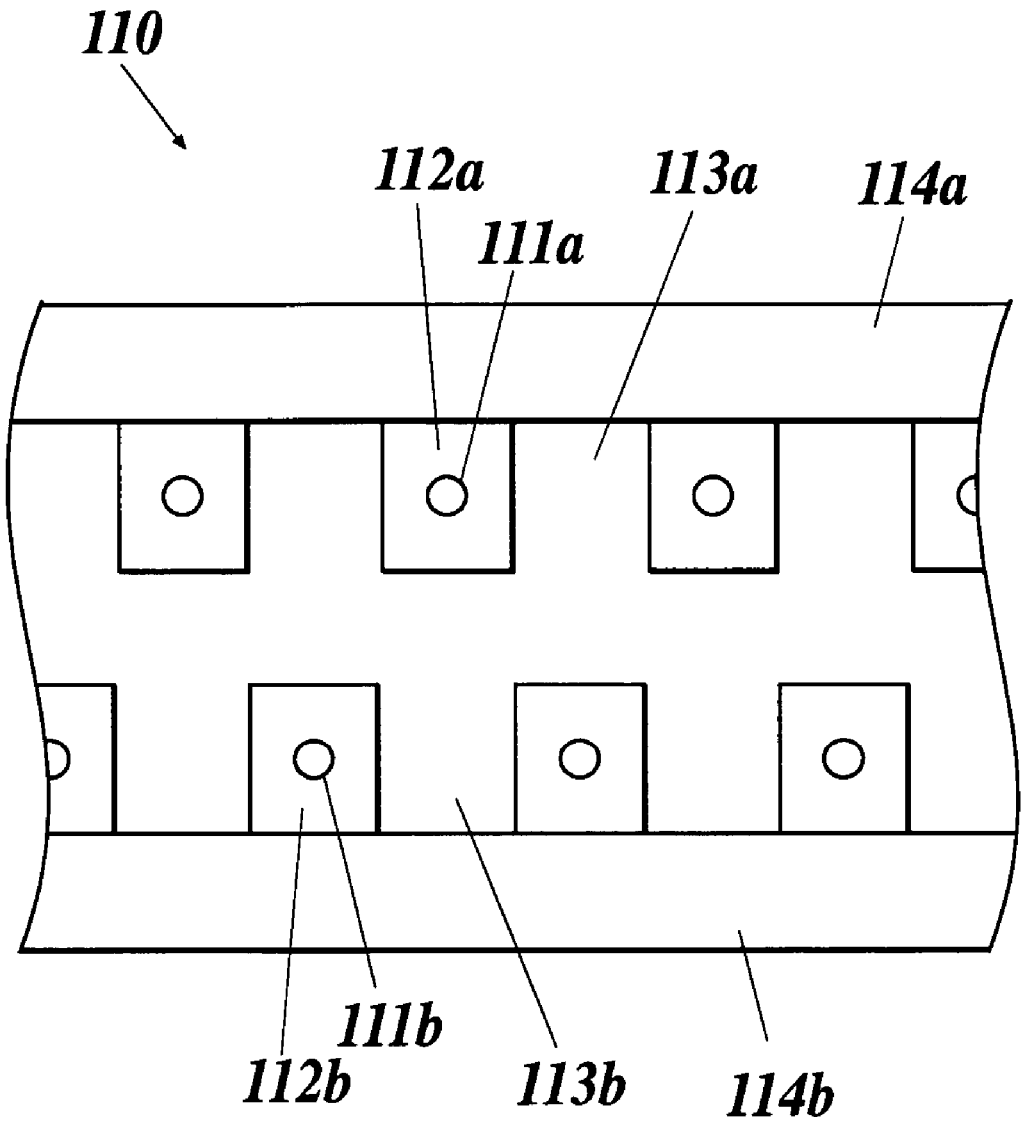
FIG. 11 is a fragmentary sectional view taken in a direction of arrows substantially along the line (iii)—(iii) of FIG. 9.

FIG. 9 is a cross sectional view of the inkjet head in accordance with the second embodiment of the invention. FIG. 10 is an exploded perspective view of FIG. 9. FIG. 11 is a fragmentary sectional view taken in the direction of arrows substantially along the line (iii)—(iii) of FIG. 9.

Referring to FIG. 9 and FIG. 10, the inkjet printer head chip 110 (hereafter referred as head chip), which is used as an actuator, consists mainly of piezoelectric ceramics wherein a plurality of channels (part or the entire ink flow passage within the head chip) 112*a*, 112*b* having ink jetting openings (nozzle) 111*a* and 111*b* for printing are lined up. A first manifold 120*a* and a second manifold 120*b* are respectively fixed to the lateral sides (upper side and low side in FIG. 9) of the head chip 110.

The head chip 110 is a ceramics component which is formed after a piezoelectric layer having opposite polarization directions is disposed on a long ruler-shaped, non-piezoelectric ceramics substrate, and which generates a change in pressure that is applied to ink.

A plurality of channels 112*a*, 112*b* that are cut with diamond blade are formed in the head chip 110. The figures here aim at showing a densification model where a piezoelectric layer having opposite polarization directions is disposed on both sides of a non-piezoelectric ceramics substrate to form a ceramics component, and a plurality of upward and downward channels 112*a*, 112*b* are aligned respectively on both sides of the ceramics component. Each of the channels 112*a*, 112*b* is cut into an elongated groove shape, forming a barrier 113*a* and a barrier 113*b*. The barrier 113*a* is formed between the channels 112*a*, 112*a* that adjoin the uncut piezoelectric ceramics, and the barrier 113*b* is formed between the channels 112*b*, 112*b* that adjoin the uncut piezoelectric ceramics (refer to FIG. 11). The depth of each of the channels 112*a*, 112*b* becomes shallow gradually as it goes to the right as shown in FIG. 9, and then finally vanishes. Metal electrodes are formed in part of the interior surface of the channels 112*a*, 112*b* (not shown in the figure).

Besides, on the top of each of the channels 112*a*, 112*b*, covering substrates 114*a*, 114*b* that are built of non-piezoelectric ceramics substrate are adhered thereto, sealing the upper side of each of the channels 112*a*, 112*b*.

It is desirable to use as an non-piezoelectric ceramics substrate at least one of alumina, aluminum, zirconia, silicon, silicon carbide and quartz, making it possible to securely support a ceramics that is polarized even with the barriers 113*a*, 113*b* shear-deformed.

Examples of the piezoelectric ceramics are such ceramics as PZT and PLZT, mainly microcrystal compounds such as PbOx, ZrOx, TiOx, which have contained therein micro metallic oxides that are known as softening agents or curing agents, preferably oxides of Nb, Zn, Mg, Ni, La, Cr.

PZT is preferred in that it is a lead zirconate titanatewhich, which has a high packing density and has a large piezoelectric constant, allowing a fine processability. After being calcined, PZT changes suddenly in crystal structure when the temperature is decreased, causing the atoms to deviate, which results in a gathering of fine crystals that are of a dipole shape with one side being plus and the other side being minus. This kind of self-polarization is random in direction, causing the polarity to counteract each other, henceforth, a need for further polarization processing.

The polarization processing is done by interposing a thin PZT plate with electrodes and immersing it into silicon oil, a high electric field of 10~35 kv/cm is then applied thereto, allowing the PZT to be polarized. When an voltage is applied to the polarized PZT in the direction perpendicular to the polarization direction, the side wall is then shear-deformed into V-shaped in the oblique direction due to the piezoelectric effect, which further causes the volume of the ink chamber to expand.

Gold, silver, aluminum, palladium, nickel, tantalum and titanium can be used as the materials of metal electrode, out of which gold and aluminum are preferred in that they can be formed by plating, deposition and spatter, especially from the view of the point of both electric characteristics and processibility.

Referring to FIG. 9, a nozzle plate 111 is adhered to the left end side of (front surface) the head chip 110. On the nozzle plate 111, ink jetting openings 111*a*, 111*b* are disposed at a place corresponding to the location of the channels 112*a*, 112*b*, and nozzle rows 115*a*, 115*b* are lined into upward and downward rows formed by a plurality of ink jetting openings 111*a*, 111*b* that are disposed corresponding to each of the channels 112*a*, 112*b* (refer to FIG. 10). The aforementioned nozzle plate 111 is formed of plastics made from such as poly-alkylene terephthalate like PET, polyimide, poly-etherimido, poly-etherketone, poly-ether sulfone, polycarbonate and cellulose acetic.

FIG. 11 shows one portion of the channels 112*a*, 112*b*, each of which is cut into an elongated groove shape. The channel 112*a* is associated to the barrier 113*a* while the channel 112*b* is associated to the barrier 113*b*. A shear deformation of the barriers 113*a*, 113*b* causes a change in pressure in the channels 112*a*, 112*b*. The orientation of the channels 112*a*, 112*b* is in the direction that is parallel displaced along the direction perpendicular to the longitudinal direction of each of the up and down rows respectively, and the channels 112*a*, 112*b* in each row are aligned evenly spaced to each other.

In FIG. 9, signal wires of 130*a*, 130*b* which package signal wires corresponding to each of the channels 112*a*, 112*b* are adhered to the right end side of the head chip 110 with epoxy type adhesives, which allows conducting with the metal electrodes. The signal wires of 130*a*, 130*b* are omitted in FIG. 10.

A driving signal transmitted from the body of the inkjet printer through the signal wires of 130*a*, 130*b* causes the barriers 113*a*, 113*b* of each of the channels 112*a*, 112*b* to be shear deformed, which causes the ink to be jetted from the ink jetting openings 111*a* and 111*b* that are being subject to a stress. The ink jetted from the ink jetting openings 111*a* and 111*b* is flying along the longitudinal direction of the channels 112*a*, 112*b* before finally arriving on a recording medium such as a paper.

Ink supply openings 1141*a*, 1141*b* are formed on each of the covering substrates of 114*a* and 114*b* corresponding to the shallow portion of each of the channels 112*a*, 112*b*. A first manifold 120*a* and a second manifold 120*b* are adhered to the head chip 110 in such a way that the ink supply openings 1141*a*, 1141*b* are covered upward.

The first manifold 120*a* and the second manifold 120*b* are components which form approximately rectangular parallelepiped common ink chambers 121*a*, 121*b* together with the head chip 110, and are made of such synthetic resins as acrylic, polycarbonate, nanocomposite, poly butylenes terephthalate, out of which nanocomposite and poly butylenes terephthalate are preferred in that they have good resistance to ink. And nanocomposite is a polyamide that has silica particles contained therein.

The first manifold 120*a* and the second manifold 120*b* are formed in such a way that they cover up the ink supply openings 1141*a*, 1141*b*, and meanwhile they have such a dimension which enables them to house therein the common ink chambers 121*a*, 121*b* which are in communication with the ink supply openings 1141*a*, 1141*b* and which have a sufficient volume. The first manifold 120*a* and the second manifold 120*b* engage with each other on the left and right lateral sides of the heap chip 10 (the alignment direction of each of channels 112*a*, 112*b*), and are respectively attached to the head chip 110 with which being interposed by the first manifold 120*a* and the second manifold 120*b*. Illustrated in FIG. 10 is only the first manifold 120*a* that is disassembled from the head chip 10.

In FIG. 10, reference numerals 122*a*, 122*b* are ink inlet openings for supplying (pouring) ink to each of the common ink chambers 121*a*, 121*b*. The ink which is supplied from the ink inlet openings 122*a*, 122*b* to each of the common ink chambers 121*a*, 121*b* is distributed to each of the channels 112*a*, 112*b* through the ink supply openings 1141*a*, 1141*b*.

Ink heaters 140*a*, 140*b* are completely embedded in the wall of the first manifold 120*a* and the second manifold 120*b*. In FIG. 9, reference numerals 141*a*, 141*b* are ink heater wires for supplying electricity to the ink heaters 140*a*, 140*b*, and these wires are connected to a driving. circuit that is now shown in the figure. The ink heaters 140*a*, 140*b* have a substantial dimension as that of the common ink chambers 121*a*, 121*b* both in width in the parallel direction of each of the channels 112*a*, 112*b*, and in length in the longitudinal direction of each of the channels 112*a*, 112*b*.

Therefore, when electric power is supplied to each of the ink heaters 140*a*, 140*b* through these ink heater wires 141*a*, 141*b*, the ink heaters 140*a*, 140*b* are then heated, allowing the heat to be transferred to the wall of the first manifold 120*a* and the second manifold 120*b* where the ink heaters 140*a*, 140*b* are being embedded, which further heats both the first manifold 120*a* and the second manifold 120*b* overall. As a result, the ink heaters are in thermal contact with the ink inside the common ink chambers 121*a*, 121*b* that are formed by the first manifold 120*a* and the second manifold 120*b*, causing the ink to be heated.

The invention highlights in such a way that ink is not directly heated by the ink heaters 140*a*, 140*b*, but. instead by heating the first manifold 120*a* and the second manifold 120*b* overall by the ink heaters 140*a*, 140*b*. That the ink heaters 140*a*, 140*b* are being embedded in the wall of the first manifold 120*a* and the second manifold 120*b* reduces the possibility of nonuniform ink heating that is caused, for example, by nonuniformity of adhesive coating as in the conventional way. Heating the first manifold 120*a* and the second manifold 120*b* overall allows the ink inside the common ink chambers 121*a*, 121*b* to be uniformly heated, which further eliminates the differences in temperature of the ink that is distributed to each of the channels 112*a*, 112*b* from the common ink chambers 121*a*, 121*b*.

In addition, the ink heaters 140*a*, 140*b* are being embedded in the wall of the first manifold 120*a* and the second manifold 120*b*, making it possible to configure an inkjet head which has the ink heaters 140*a*, 140*b* by a manufacturing process of only imposing the first manifold 121*a* and the second manifold 120*b*, which further eliminates the need to increase the manufacturing man-hour. Especially, if adhesives are used, the excessive adhesives, when heated to harden, are likely to flow into the manifold, causing the head to be likely clogged. However, such possibility is completely absent in the embodiment.

When each of the ink heaters 140*a*, 140*b* is integrally molded with the first manifold 120*a* and the second manifold 120*b*, making it possible to have the ink heater 140*a*, 140*b* be in closed contact with the interior of the wall of the first manifold 120*a* and the second manifold 120*b*, which further makes it possible to transfer the heat effectively from the ink heaters 140*a*, 140*b* to the entire manifold. This enables that the ink inside the common ink chambers 121*a*, 121*b* is efficiently and uniformly heated, hence, it is preferable to have such an embodiment.

In particular, preferably, the ink heaters 140*a*, 140*b* are integrally molded with the first manifold 120*a* and the second manifold 120*b* by injection molding. In addition to the above advantageous effect, there is also another advantage, that is, by using shaping dies makes it possible to simply manufacture the manifold in the wall of which is embedded an ink heater.

As long as embedding the ink heaters 140*a*, 140*b* in the wall of the first manifold 120*a* and the second manifold 120*b* makes it possible to heat the first manifold 120*a* and the second manifold 120*b* overall, while it doesn't matter what kind of ink heater is used, a film type heater 1400 is still preferred.

Figure 12:
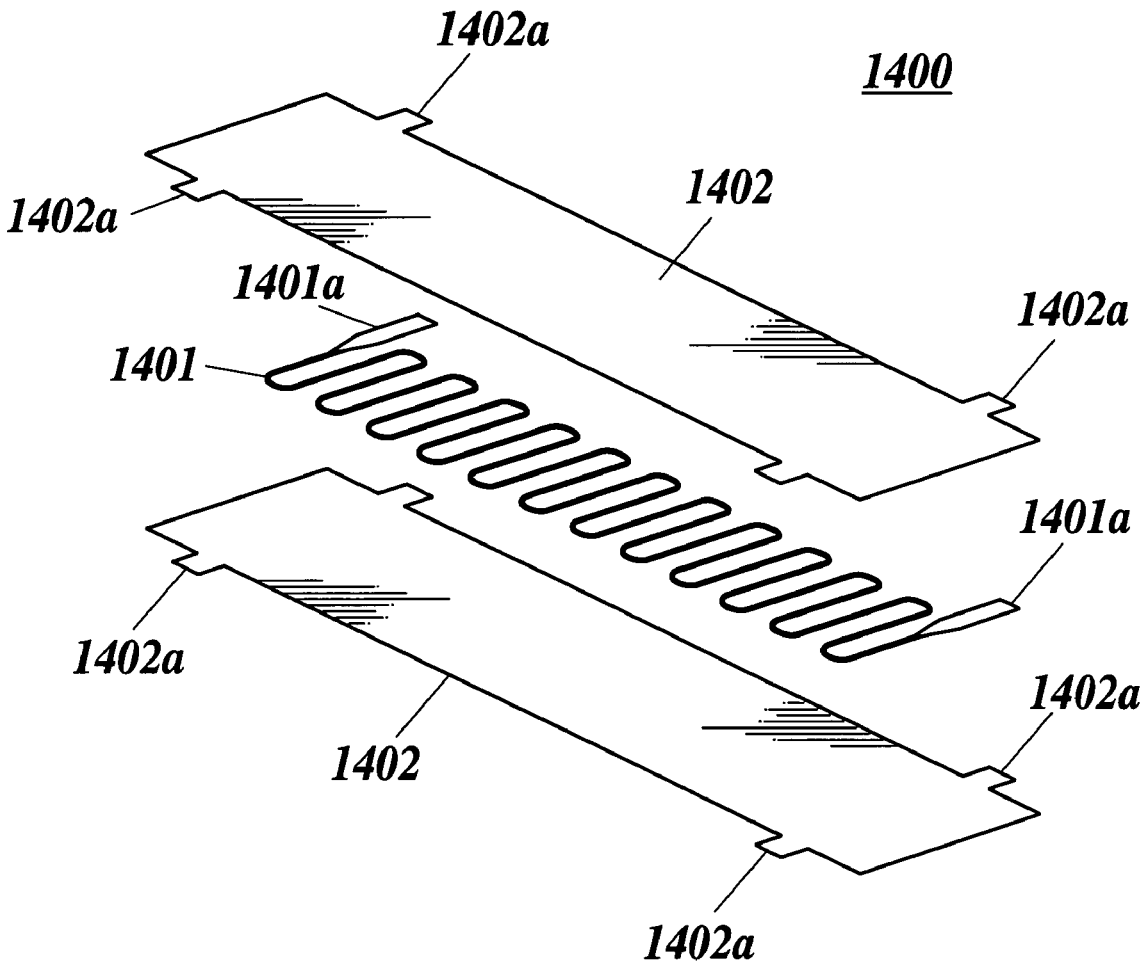
FIG. 12 is an exploded view of one example of an ink heater in accordance with the second embodiment of the invention.

A film type heater 1400, as shown in FIG. 12, is formed by laminating a heater circuit 1401 with a film 1402. The film type heater 1400 is a heat dissipation element made of stainless materials and the film 1402 is an insulating film such as polyethylene terephthalate. That such film type heater 1400 is of substantially several dozen μm in width makes it easily to be embedded in the wall of the first manifold 120*a* and the second manifold 120*b* without the need to further increase the width of the wall. As a result, the manifold as such is of macro-scale, which further eliminates the need for an inkjet print that is of macro-scale.

Besides, the several-dozen-μm-wide film type heater 1400, if to be adhered with an adhesive, curls up when the adhesive is hardening, causing the heat transfer surface to be likely nonuniform; but embedding the film type heater in the wall makes it possible to avoid this kind of problems.

Referring to FIG. 12, reference numeral 1401*a* shows a connection unit connecting to the heater wires 141*a*, 141*a* on both end sides of the heater circuit 1401. Reference numeral 1402*a* is a supporting rib used to locate and support in the shaping dies when the film type heater 1400, which is first formed by laminating the heater circuit 1401 with insulating films 1402 and 1402, is integrally molded with the first the first manifold 120*a* and the second manifold 120*b*.

Figure 13:
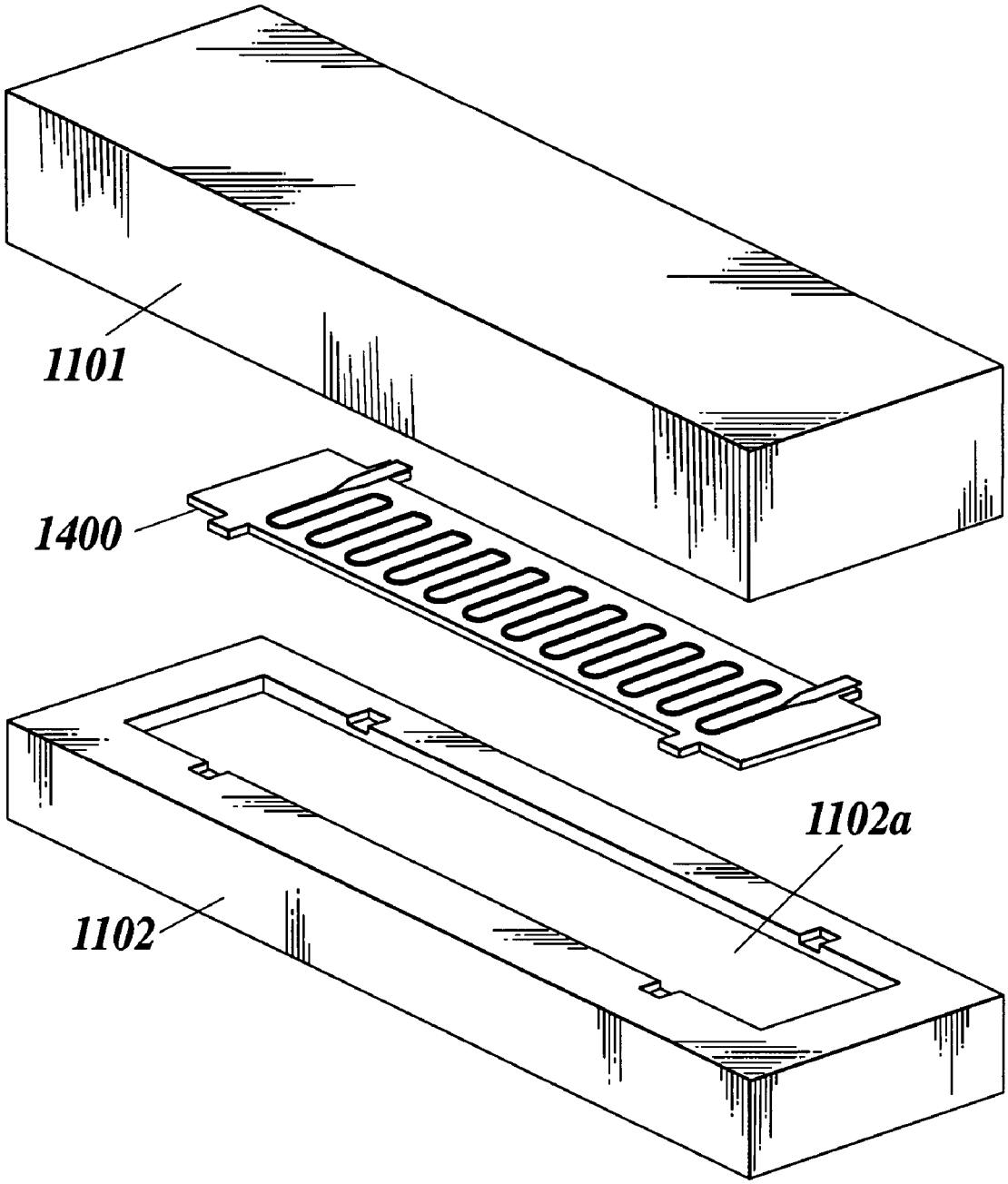
FIG. 13 illustrates a film type heater that is to be integrally molded with a manifold.
Figure 14:
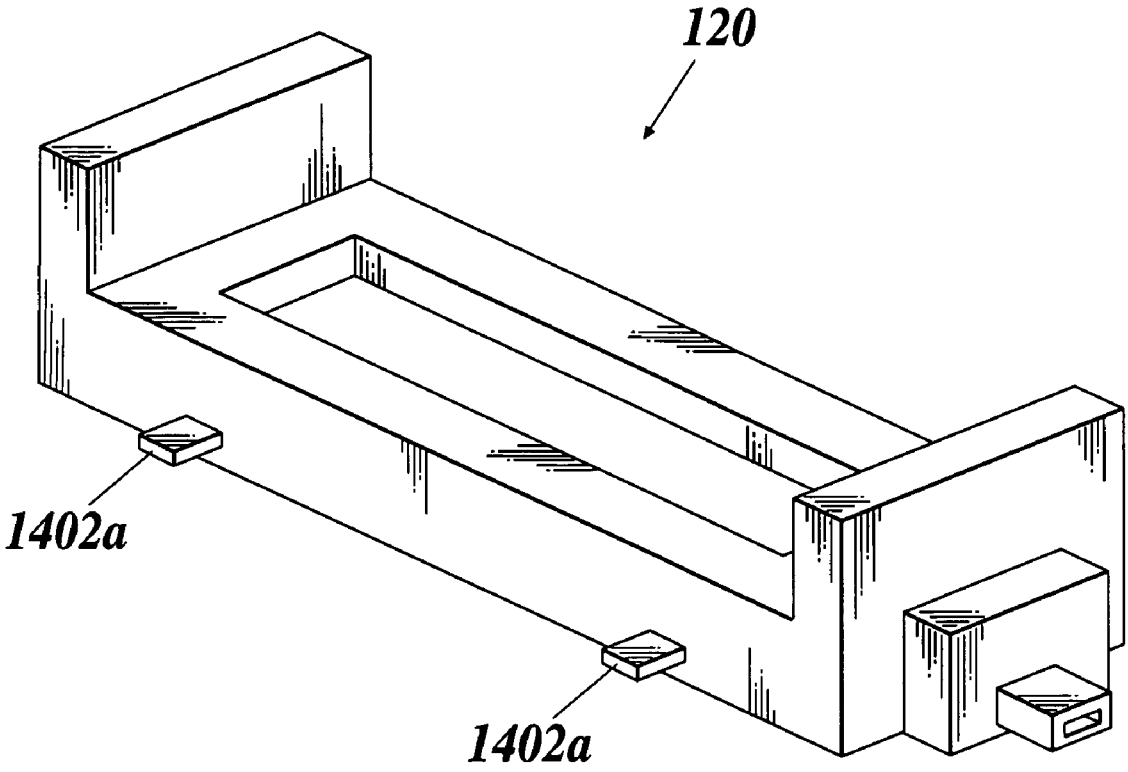
FIG. 14 is a perspective view illustrating an exterior of a manifold which has been integrally molded with a film type heater.

As shown in FIG. 13, in order to integrally mold the film type heater 1400 with the first manifold 120*a* and the second manifold 120*b*, first, prepare respectively an upper mold 1101, and a low mold 1102. The upper mold 1101 is formed of a concave portion that is used to mold the manifolds (the first manifold 120*a* and the second manifold 120*b*). The low mold 1102 is formed of a concave portion 1102*a* that is used to arrange the film type heater 1400; secondly, seal the mold after the film type heater 1400 is placed in such a way so that it coincides with the concave portion 1102*a* of the lower mold 1102; thirdly, pour resin into the cavity by an injection molding machine; and finally open the mold after the resin is fully cooled. In this way, as shown in FIG. 14, the manifold 120 is finally completed with the film type heater 1400 entirely embedded therein. At this time, the projecting rib 1402*a* for supporting can be removed.

According to the inkjet head in accordance with the embodiment, supplying electric power to the ink heater 140*a* and 140*b* makes it possible to uniformly heat a high viscosity ink, such as a UV curable ink that is used to record images. This enables a viscosity that is best for jetting, which further make it possible to jet the ink efficiently.

In addition, since whether the ink is heated depends on whether electric power is supplied to the ink heaters 140*a*, 140*b*, such an inkjet head can be used without any configuration even in common cases where there is no need to heat the ink by stopping electric power supply to the ink heaters 140*a*, 140*b*.

In FIG. 9, reference numerals 150*a*, 150*b* are temperature sensors which are installed respectively in the first manifold 120*a* and the second manifold 120*b* for detecting temperatures. Reference numerals 151*a*, 151*b* are wirings that extract detection signals from each of the temperature sensors 150*a*, 150*b*.

The ink heaters 140*a*, 140*b* heat the first manifold 120*a* and the second manifold 120*b* overall, making it possible to heat the ink uniformly. This enables the temperature of the ink inside the common ink chambers 121*a*, 121*b* to be detected indirectly from the temperature of the first manifold 120*a* and the second manifold 120*b* by setting the temperature sensors 150*a*, 150*b* in the manifolds 120*a*, 120*b*. The ink heaters 140*a*, 140*b* heat the entire body of the manifolds 120*a*, 120*b* uniformly, allowing the ink temperature to be detected correctly without knowing the detailed layout position of the temperature sensors 150*a*, 150*b* as long as the two sensors are set inside the two manifolds.

The temperature sensors 150*a*, 150*b* are disposed in the first manifold 120*a* and the second manifold 120*b* so as to being able to detect the temperature of the first manifold 120*a* and the second manifold 120*b*.

In addition, the temperature sensors for detecting the ink temperature may be disposed in addition to the temperature sensors that detect the temperature of the head chip 110.

Figure 15:
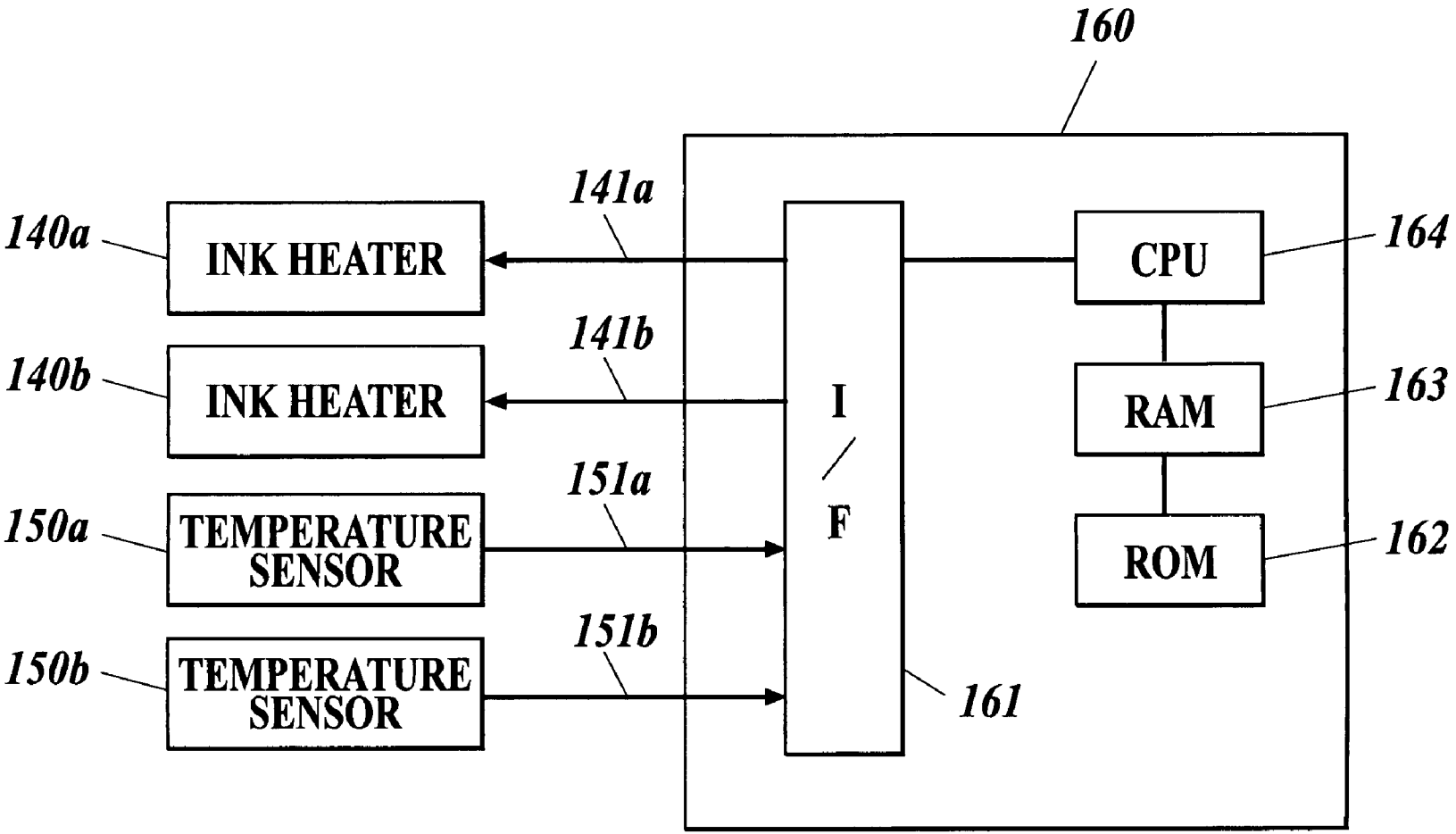
FIG. 15 is a block diagram illustrating one exemplary configuration of a control unit.

FIG. 15 is a block diagram that shows one exemplary configuration of a control unit 160 of the inkjet printer in accordance with the embodiment of the invention.

The control unit 160 which consists mainly of an interface 161, ROM 162, RAM 163 and CPU 164, controls various instruments that are connected to the interface 161 according to the control programs and control data that are written into the ROM 162.

Each of the ink heaters 140*a*, 140*b*, and each of the temperature sensors 150*a*, 150*b* are electrically connected to the interface 161.

Various data, various control programs concerning the operation of each component of the inkjet printer and control data, and the like are written in the ROM 162. Among various data are, for example, a standard ink temperature for deciding whether to heat the ink by ink heaters 140*a*, 140*b*; the heating temperature data of each of the ink heaters 140*a*, 140*b*; and the like.

The standard ink temperature (the predetermined temperature t), in the case of UV curable ink, is set to a value higher than the one that allows the UV curable ink to be jetted stably from the common ink chambers 121*a*, 121*b*. The heating temperature data of each of the ink heaters 140*a*, 140*b* is set in such a way: the heating temperature which allows the UV curable ink to be heated to be above the possible stable jetting temperature by each of the ink heaters 140*a*, 140*b* is set corresponding to the ink temperature to be detected by each of the temperature sensors 150*a*, 150*b*. In other words, if the ink temperature detected is low, indicating a large amount of heat should be provided to the ink. Then the heating temperature is set to a high value temperature; if the ink temperature detected is high, indicating that there is no need to supply that amount of heat to the ink. Then the heating temperature is set to a low temperature.

The RAM 163 is capable of storing a plurality of data inputted only during the period when electric power is supplied thereto. It also has a storing area for storing various data including the image data to be printed, and an operation area by the CPU 164.

The CPU 164 frees predetermined programs to the working area of the RAM 163 from various programs being stored in the ROM 162, and executes various processing tasks instructed by the program in accordance with each input signal.

Figure 16:
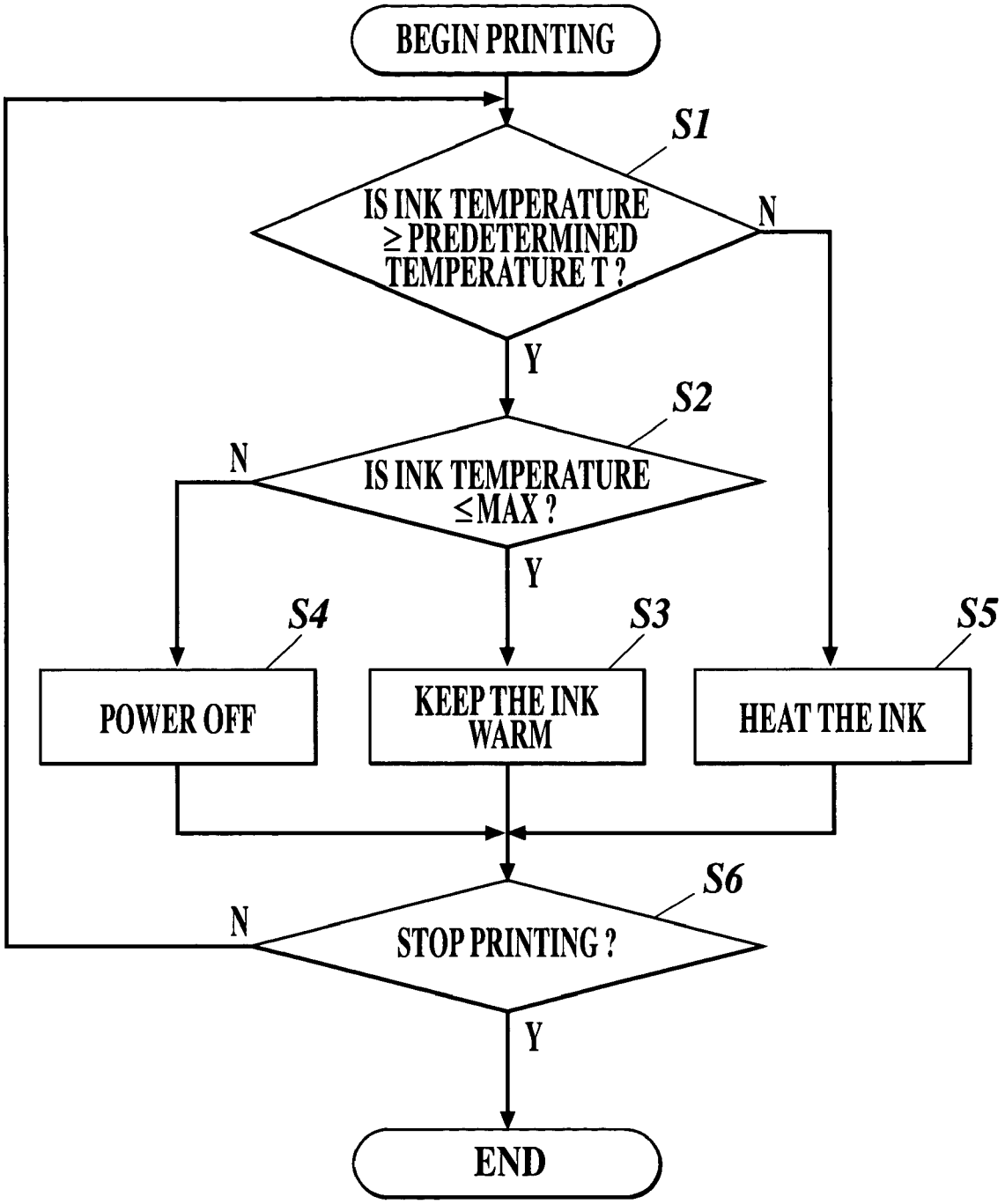
FIG. 16 is a flow chart illustrating one exemplary operation of the control unit.

While control unit 160 is a unit that controls the entire operation of the inkjet printer, the control part of the ink heaters 140*a*, 140*b* is here mainly explained with reference to FIG. 16 which shows one exemplary control flow.

On turning on the printer, the ink temperature is detected by each of the temperature sensors 150*a*, 150*b* (step S1). If the ink temperature is higher than the predetermined temperature T that permits for a stable ink jetting, then at next step, whether the ink temperature exceeds the maximum temperature (MAX) that enables sufficient ink jetting is decided (step S2).

If the ink temperature does not exceed the maximum temperature (MAX), the ink is kept at a temperature by controlling the electrification of each of the ink heaters of 140*a* and 140*b* so that the temperature of the ink in the common ink chambers 121*a*, 121*b* does not decrease (step 3).

On the other hand, if the ink temperature exceeds the maximum temperature (MAX) in the step 2, heating of the common ink chambers 121*a*, 121*b* should be stopped, and the electrification of the ink heaters 140*a*, 140*b* is so controlled as to stop the electrification (step 4).

In addition, in the above step S1, if the ink temperature is lower than the temperature that allows for a stable jetting, a heating temperature data that corresponds to the ink temperature detected by each of the temperature sensors 150*a*, 150*b* is chosen, the ink in the common ink chambers 121*a*, 121*b* should be heated to a temperature that is higher than the predetermined temperature T by controlling the electrification of the ink heaters 140*a*, 140*b* through the first manifold 120*a* and the second manifold 120*b* based on the heating temperature data (S5).

After any one of the steps S3, S4 and S5, the current printing stage is checked: if the printing is under way, then return back to the step S1, and repeat the flow that detects the ink temperature by each of the temperature sensors 150*a*, 150*b*; If the printing is over, each printing operation is stopped and the flow is finally terminated. In order to ensure a stable jetting during a printing stage, operations of heating, keeping at a certain temperature or stopping the electrification may be repeated.

According to the inkjet printer in accordance with the embodiment, the control of the ink heaters 140*a*, 140*b* according to the detection of the ink temperature through the temperature sensors 150*a*, 150*b* eliminates the possibility of wasteful heating by the ink heaters 140*a*, 140*b*, and insufficient heating, maintaining a regular and stable ink temperature, which further makes it possible to have a stable ink jetting.

In addition, the shape of the ink heater can be either of such a shape as the one of the first embodiment wherein the heating density varies in the longitudinal direction, or of a waveform shape where the pitch becomes narrow on end side in the longitudinal direction.

Explained so far is such an inkjet head system that generates changes in pressure that is applied to the ink by shear deforming the barriers formed between each of the channels. However, in the invention, methods of generating changes in pressure are not limited to this. For example, any one of the following systems may be used instead: a piezoelectric system which employs a displacement (i.e. a change in force) resulting from a distortion generated by applying appropriate electric signals to piezoelectric elements; a thermal or bubble jet (registered trademark) system which employs an expansion pressure generated by supplying heat to the interior of a pressure chamber; or the like.

Although the present invention has been explained according to the embodiments, it should also be understood that the present invention is not limited to the embodiments and that various changes and modifications may be made to the invention from the gist thereof.

The entire disclosure of Japanese Patent Applications No. 2003-314003 filed on Sep. 5, 2003 and No. 2003-330786 filed on Sep. 22, 2003 including specification, claims, drawings and summary is incorporated herein by reference in its entirety.

What is claimed is:

1. An inkjet head comprising:

an inkjet head chip including ink jetting openings which are lined up to form at least one nozzle row on a front surface of the inkjet head chip;

a manifold which is attached securely to a side of the inkjet head chip and which leads ink to the inkjet head chip; and an ink heater which: (i) is in thermal contact through the manifold with ink in the manifold, (ii) extends along a direction in which the nozzle row extends so as to correspond to at least a plurality of the ink jetting openings, and (iii) varies in heat generation density in the direction in which the nozzle row extends.

2. The inkjet head of claim 1, wherein the ink heater has a higher heat generation density at both ends of the nozzle row than at a middle of the nozzle row.

3. The inkjet head of claim 1, wherein the ink heater is disposed on a side of the manifold that is opposite to a side of the manifold which is securely attached to the inkjet head chip.

4. The inkjet head of claim 3, further comprising a case frame to hold the manifold, wherein the ink heater is arranged between the manifold and the case frame.

5. An inkjet head comprising:

an inkjet head chip including ink jetting openings which are lined up to form at least one nozzle row on a front surface of the inkjet head chip;

a manifold which is attached securely to a side of the inkjet head chip and which leads ink to the inkjet head chip; and an ink heater which is in thermal contact through the manifold with ink in the manifold, and which varies in heat generation density in a direction of the nozzle row;

wherein the ink heater comprises a heating wire having at least one waveform, and a change in the number of the waveforms of the heating wire with respect to a predetermined area causes a corresponding change in heat generation density thereof.

6. The inkjet head of claim 5, wherein the ink heater has a higher heat generation density at both ends of the nozzle row than at a middle of the nozzle row.

7. An inkjet head comprising:

an inkjet head chip including ink jetting openings which are lined up to form at least one nozzle row on a front surface of the inkjet head chip;

a manifold which is attached securely to a side of the inkjet head chip and which leads ink to the inkjet head chip; and an ink heater which is in thermal contact through the manifold with ink in the manifold, and which varies in heat generation density in a direction of the nozzle row;

wherein the ink heater is embedded in a wall of the manifold.

8. The inkjet head of claim 7, wherein the ink heater is integrally molded with the manifold.

9. An inkjet head comprising:

an inkjet head chip including ink jetting openings which are lined up to form a plurality of nozzle rows on a front surface of the inkjet head chip;

a plurality of manifolds which are attached securely to a side of the inkjet head chip so as to be positioned symmetrically with respect to a plane of the inkjet head chip, and which lead ink to the inkjet head chip; and an ink heater provided in each of the manifolds so as to be in thermal contact through the corresponding manifold with ink in the manifold;

wherein each ink heater varies in heat generation density in a direction of the nozzle rows.

10. The inkjet head of claim 9, wherein each ink heater has a higher heat generation density at both ends of the nozzle rows than at a middle of the nozzle rows.

11. The inkjet head of claim 9, wherein each ink heater comprises a heating wire having at least one waveform, and a change in a number of the waveforms of the heating wire with respect to a predetermined area causes a corresponding change in heat generation density thereof.

12. The inkjet head of claim 11, wherein the ink heater has a higher heat generation density at both ends of the nozzle row than at a middle of the nozzle row.

13. An inkjet head comprising:

a plurality of ink jetting openings arranged in at least one nozzle row;

a manifold which leads ink toward the ink jetting openings an ink supply inlet opening to supply ink into the manifold; and an ink heater, which: (i) extends along a direction in which the nozzle row extends so as to correspond to at least a plurality of the ink jetting openings, (ii) is adapted to heat supplied ink, and (iii) has a higher heat generation density in a vicinity of the ink supply inlet opening than at another part of the ink heater.

14. An inkjet head comprising:

an inkjet head chip including a plurality of channels for generating a change in pressure which is applied to ink and for jetting ink from corresponding ink jetting openings which are formed in parallel to each other;

a manifold attached to the inkjet head chip and forming a common ink chamber to distribute ink to each of the channels; and an ink heater which is embedded in the manifold and which is in thermal contact with ink in the common ink chamber.

15. The inkjet head of claim 14, wherein the ink heater is integrally molded with the manifold.

16. The inkjet head of claim 15, wherein the ink heater is integrally molded with the manifold by injection molding.

17. The inkjet head of claim 14, wherein the ink heater comprises a film type heater.

* * * * *